US010995536B2

(12) United States Patent
Song et al.

(10) Patent No.: US 10,995,536 B2
(45) Date of Patent: May 4, 2021

(54) REFRIGERATOR

(71) Applicant: Samsung Electronics Co., Ltd., Suwon-si (KR)

(72) Inventors: Young Il Song, Hwaseong-si (KR); Ii Sung Bae, Seongnam-si (KR); Jae Koog An, Gwangju (KR); Kwan Yeol Lee, Hwaseong-si (KR); Joo Yong Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 49 days.

(21) Appl. No.: 15/860,429

(22) Filed: Jan. 2, 2018

(65) Prior Publication Data

US 2018/0187470 A1 Jul. 5, 2018

(30) Foreign Application Priority Data

Jan. 3, 2017 (KR) ..... 10-2017-0000953
Jun. 9, 2017 (KR) ..... 10-2017-0072734

(51) Int. Cl.
*F25D 11/02* (2006.01)
*F25D 23/02* (2006.01)
(Continued)

(52) U.S. Cl.
CPC ..... *E05F 15/619* (2015.01); *F25D 11/02* (2013.01); *F25D 23/028* (2013.01);
(Continued)

(58) Field of Classification Search
CPC ..... E05F 15/619; E05F 11/02; E05F 23/028; E05F 23/087; F25D 29/003; F25D 29/005; F25D 2323/02; F25D 2700/02; F25D 11/02; F25D 23/028; F25D 23/087; E05Y 2900/31
See application file for complete search history.

(56) References Cited

U.S. PATENT DOCUMENTS 6,338,536 B1 * 1/2002 Ueno ..... E05B 17/0033 312/405
9,062,911 B2 * 6/2015 Keller ..... F25D 17/047
(Continued)

FOREIGN PATENT DOCUMENTS

DE 202013011428 U1 * 3/2015 ..... E05F 15/619
JP 2006200891 A * 8/2006
(Continued)

OTHER PUBLICATIONS

International Search Report dated Apr. 19, 2018 in connection with International Patent Application No. PCT/KR2018/000103.
(Continued)

*Primary Examiner* — Andrew M Roersma

(57) ABSTRACT

Disclosed herein is a door opening apparatus capable of preventing degradation of appearance quality of a door because an additional switch is not provided, and a refrigerator including the same. The refrigerator may include a main body including a storage compartment, a door provided to open or close the storage compartment, and a door opening apparatus provided to detect a moving amount of the door and open the door when the door is pushed.

17 Claims, 22 Drawing Sheets

(51) Int. Cl.
*F25D 23/08* (2006.01)
*F25D 29/00* (2006.01)
*E05F 15/619* (2015.01)

(52) U.S. Cl.
CPC ..... *F25D 23/087* (2013.01); *F25D 29/003* (2013.01); *F25D 29/005* (2013.01); *E05Y 2900/31* (2013.01); *F25D 2323/02* (2013.01); *F25D 2700/02* (2013.01)

(56) References Cited

U.S. PATENT DOCUMENTS

2008/0083243 A1 4/2008 Lee et al.
2008/0134698 A1* 6/2008 Oho ..... F25D 23/028 62/127
2010/0096092 A1* 4/2010 Liu ..... E05F 15/70 160/310
2010/0141107 A1* 6/2010 Kim ..... F25D 23/028 312/405
2011/0048060 A1 3/2011 Kim et al.
2011/0083461 A1 4/2011 Kim
2013/0154461 A1* 6/2013 Bohle ..... E05F 15/614 312/319.6
2015/0338156 A1* 11/2015 Held ..... F25D 29/005 312/405
2017/0261252 A1* 9/2017 Son ..... F25D 23/028
2017/0288181 A1 10/2017 Hwang et al.
2018/0038637 A1* 2/2018 Kim ..... F25D 23/02

FOREIGN PATENT DOCUMENTS

KR 10-2007-0111856 A 11/2007
KR 10-2012-0003772 A 1/2012
KR 10-1537377 B1 7/2015
KR 10-2016-0029516 A 3/2016
KR 10-2016-0099523 A 8/2016
WO WO-2007042933 A1 * 4/2007 ..... E05F 11/54

OTHER PUBLICATIONS

Office Action dated Nov. 27, 2019 in connection with India Patent Application No. 201817032493, 6 pages.

* cited by examiner

REFRIGERATOR

CROSS-REFERENCE TO RELATED APPLICATIONS AND CLAIM OF PRIORITY

This application is related to and claims priority to Korean Patent Application No. 10-2017-0000953, filed on Jan. 3, 2017 and Korean Patent Application No. 10-2017-0072734, filed on Jun. 9, 2017, the contents of which are incorporated herein by reference.

TECHNICAL FIELD

Embodiments of the present disclosure relate to a door opening apparatus and a refrigerator including the same, and more particularly, to a door opening apparatus configured to automatically open a door without an additional switch, and a refrigerator including the same.

BACKGROUND

Generally, doors are installed on home appliances such as refrigerators and furniture.

Gaskets configured to seal between a main body and a door of a refrigerator when the door is closed are provided between the door and the main body. The gaskets may prevent cooling air in a storage compartment from escaping to the outside by being in contact with both sides of the main body and the door.

A user opens and closes a door of a storage compartment to put food in or withdraw food from the storage compartment. When the door is opened and closed, external air is introduced into the storage compartment, the introduced external air is cooled as time passes, a specific volume thereof decreases, and thus an internal pressure of the storage compartment is lower than a pressure of an outside of the storage compartment. Accordingly, when the user opens the door, the user has to open the door with a force capable of overcoming such a pressure difference, and occasionally, the user has to apply a very big force to the door to open the door. Particularly, in a case in which a refrigerator has a heavy door and a large-capacity storage compartment, a more strong force is needed to open the door, and thus a way to easily open the door is needed.

In addition, in a case in which an additional switch has to be provided even when a door opening apparatus is provided, design sensibility quality of a door may be degraded or a material cost of the door may be increased due to the switch.

SUMMARY

To address the above-discussed deficiencies, it is a primary object to provide a door opening apparatus capable of automatically opening a door and a refrigerator including the same.

It is another aspect of the present disclosure to provide a door opening apparatus capable of preventing degradation of appearance quality of a door because an additional switch is not provided, and a refrigerator including the same.

It is still another aspect of the present disclosure to provide a door opening apparatus capable of reducing a material cost because an additional switch is not needed, and a refrigerator including the same.

It is yet another aspect of the present disclosure to provide a door opening apparatus in which convenience of a user is improved because a door is openable by pushing one side of the door, and a refrigerator including the same.

It is yet another aspect of the present disclosure to provide a door opening apparatus capable of being installed at various doors regardless of shapes and types thereof, and a refrigerator including the same.

It is yet another aspect of the present disclosure to provide a door opening apparatus in which accuracy of opening operation and convenience of a user are improved by distinguishing a push pressure applied to a door and an external impact applied to the door to determine intention of the user, and a refrigerator including the same.

Additional aspects of the disclosure will be set forth in part in the description which follows and, in part, will be obvious from the description, or may be learned by practice of the disclosure.

In accordance with one aspect of the present disclosure, a refrigerator includes a main body including a storage compartment, a door provided to open or close the storage compartment, and a door opening apparatus provided to detect a moving amount of the door and open the door when the door is pushed.

The door opening apparatus may include a detection module provided to detect the moving amount the door, a push module provided to open the door, and a controller provided to receive a signal from the detection module and control the push module.

The detection module may include a detection lever provided to be in contact with the door in a state in which the door is closed and configured to be movable in a first direction and a second direction opposite the first direction, and a detecting sensor provided to detect a displacement of the detection lever.

The detecting sensor may include a magnet provided at one side of the detection lever and configured to move together with the detection lever, and a hall element provided to detect a magnitude of a magnetic force changed according to a displacement of the magnet.

The detection module may include a detection lever provided to linearly move as much as the moving amount of the door when a front surface of the door is pushed, and a detecting sensor provided to detect a moving amount of the detection lever.

The detection module may further include an amplifying gear configured to convert a linear displacement of the detection lever into a rotational displacement thereof and amplify a displacement amount of the detection lever.

The detecting sensor may include a photo interrupter including a light emitting element and a light receiving element, and a rotating plate provided to rotate to repeatedly block or allow the light receiving element from receiving or to receive light emitted from the light emitting element.

The rotating plate may include a plurality of light shields configured to extend in a shaft direction of the rotating plate and spaced apart from each other in a circumferential direction of the rotating plate.

The rotating plate may include a gear portion having a rotational center coinciding with a rotational center of the rotating plate, and the gear portion may be provided to be engaged with the amplifying gear such that the rotating plate is rotated when the detection lever is moved linearly.

The detection module may further include an elastic member provided to elastically bias the detection lever toward the door.

The push module may include a driving motor configured to supply a driving force, and a push lever configured to receive the driving force from the driving motor and push the door in a direction in which the door is opened.

The push module may further include a decelerating gear configured to decrease a rotational displacement of the driving motor, amplify the driving force of the driving motor, and transmit the driving force of the driving motor to the push lever.

The push lever may include a rack gear portion configured to convert a rotational displacement of the decelerating gear into a linear displacement thereof and provided to be engaged with the decelerating gear.

The push lever may include a magnet provided at one side of the push lever, and the push module may further include a hall element provided to detect a magnetic field of the magnet.

The hall element may include a first hall element and a second hall element spaced apart from each other in a moving direction of the push lever, and the magnet may be provided to move between the first hall element and the second hall element.

The door opening apparatus may be disposed at an upper end or lower end of the main body.

The detection module may be disposed at an upper end or lower end of the door, and the push module may be disposed at an upper end or lower end of the main body.

In accordance with one aspect of the present disclosure, a door opening apparatus configured to open a door of a refrigerator includes a push module including a driving motor and a push lever provided to receive a driving force of the driving motor and open the door, a detection lever configured to come into contact with the door and move in a moving direction of the door when the door is pushed, and a detecting sensor provided to detect a moving amount of the detection lever.

The door opening apparatus may further include an amplifying gear connected to the detection lever and the detecting sensor and provided to convert a linear displacement of the detection lever into a rotational displacement thereof and amplify a displacement amount of the detection lever.

The detecting sensor may include a photo interrupter including a light emitting element and a light receiving element, and a rotating plate configured to rotate to repeatedly block or allow the light receiving element from receiving or to receive light emitted from the light emitting element.

The push lever may include a magnet provided at one side of the push lever, and the push module may further include a hall element provided to detect a magnetic field of the magnet.

In accordance with one aspect of the present disclosure, a refrigerator includes a main body including a storage compartment, a door provided to open or close the storage compartment, and a door opening apparatus provided to open the door when the door is pushed, wherein the door opening apparatus includes a driving motor configured to supply a driving force, a push lever provided to receive the driving force from the driving motor and open the door, a detection lever provided to move as much as a moving amount of the door when the door is pushed, an amplifying gear provided to amplify a moving amount of the detection lever, and a detecting sensor provided to detect the amplified moving amount of the detection lever.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 22, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, embodiments of the present disclosure will be described in detail with reference to the accompanying drawings.

Figure 1:
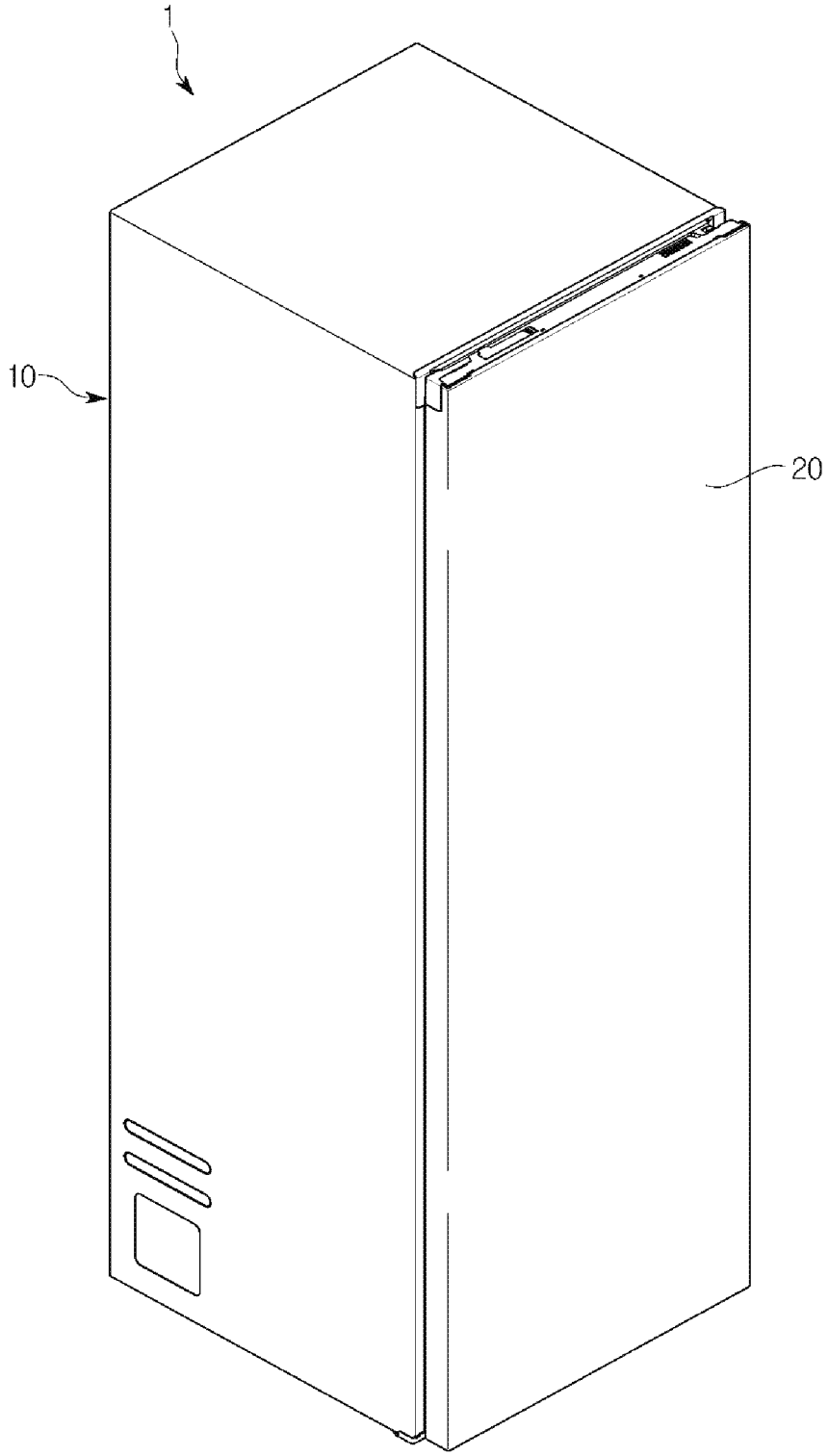
FIG. 1 is a view illustrating an exterior of a refrigerator according to one embodiment of the present disclosure when a door of the refrigerator is closed.
Figure 2:
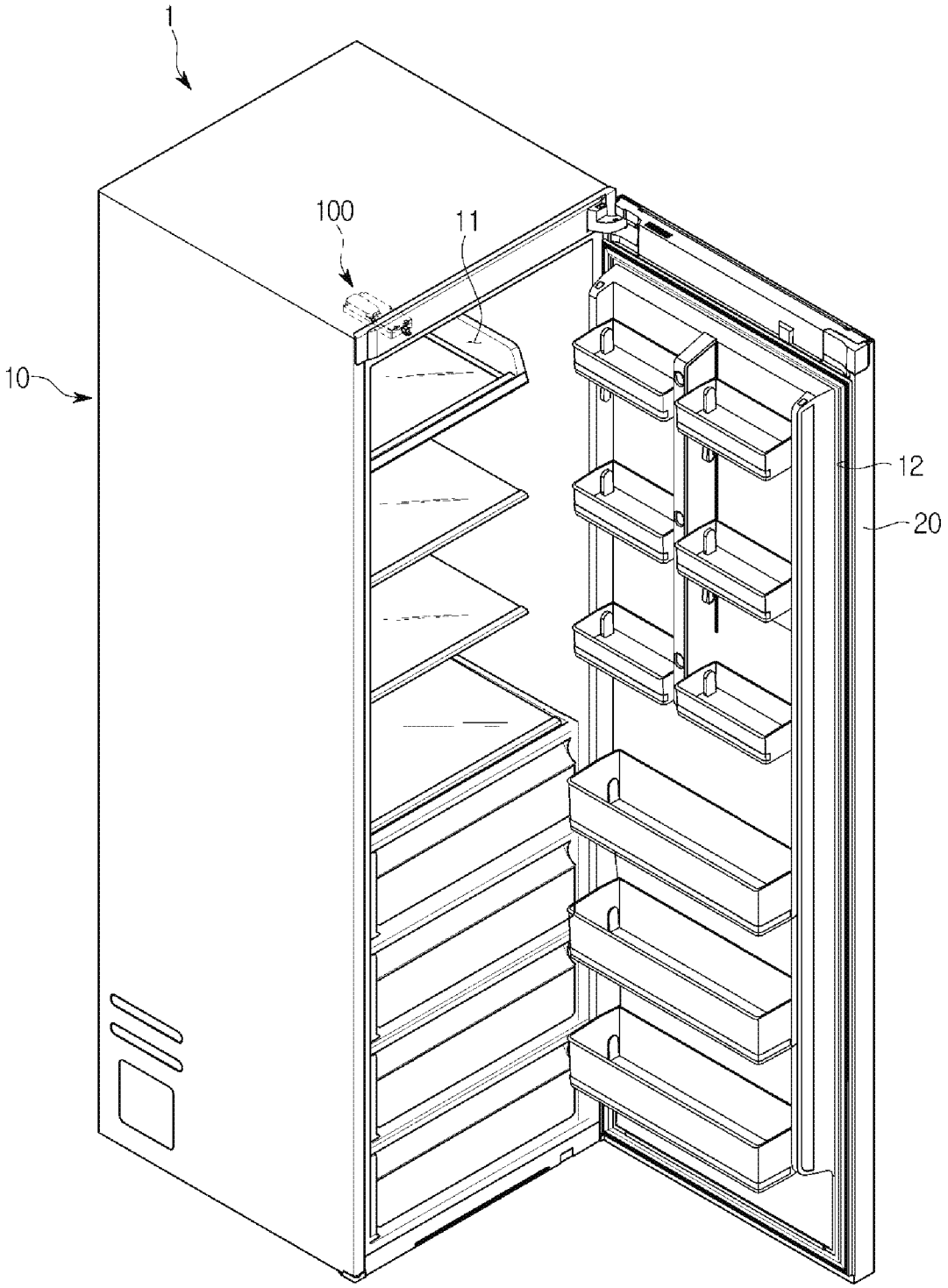
FIG. 2 is a view illustrating the exterior of the refrigerator according to one embodiment of the present disclosure when the door is open.

FIG. 1 is a view illustrating an exterior of a refrigerator according to one embodiment of the present disclosure when a door of the refrigerator is closed, and FIG. 2 is a view illustrating the exterior of the refrigerator according to one embodiment of the present disclosure when the door is open.

As illustrated in FIGS. 1 and 2, a refrigerator 1 according to one embodiment of the present disclosure may include a main body 10 including a storage compartment 11, a door 20 provided on a front surface of the storage compartment 11 and configured to open or close the storage compartment 11, and a door opening apparatus 100 for automatically opening the door 20.

The refrigerator 1 may include components such as a compressor (not shown), a condenser (not shown), an expander (not shown), and an evaporator (not shown) for forming the same freezing cycle as that for a general refrigerator.

The refrigerator 1 according to one embodiment of the present disclosure may include one storage compartment 11. The storage compartment 11 may be used as a refrigerator compartment or freezer compartment, and a temperature in the storage compartment 11 may vary.

Meanwhile, although not illustrated in the drawings, the number of storage compartments or doors may be changed without limitation. For example, the refrigerator may include two storage compartments which are disposed vertically, and may be provided as a bottom mounted freezer (BMF) type refrigerator in which a freezer compartment is disposed at a lower portion of the refrigerator or a top mounted freezer (TMF) type refrigerator in which a freezer compartment is disposed at an upper portion thereof. The refrigerator may also be a side by side (SBS) type refrigerator in which two storage compartments are disposed laterally.

According to one embodiment of the present disclosure, the door 20 may be provided to be rotatable on the main body 10. However, the door is not limited thereto, the door may be provided as a draw type door provided to be movable toward or from the main body. Therefore, according to the spirit of the present disclosure, there is also no limitation on the type of the door of the refrigerator.

The door opening apparatus 100 may be disposed at an upper end of the main body 10. The door opening apparatus 100 may be formed such that the door 20 is opened when a part of a front surface of the door 20 is pushed by a user. In this behalf, a description thereof will be described below.

Meanwhile, the door opening apparatus 100 may be disposed at a lower end of the main body 10. In addition, a plurality of door opening apparatuses 100 may be provided according to the type of the refrigerator. For example, the door opening apparatus 100 may be provided as many as the number of the doors. That is, according to the spirit of the present disclosure, the number and arrangement of the door opening apparatuses 100 may be changed according to the type, the number of doors, and design specifications of the refrigerator without limitation.

Figure 3:
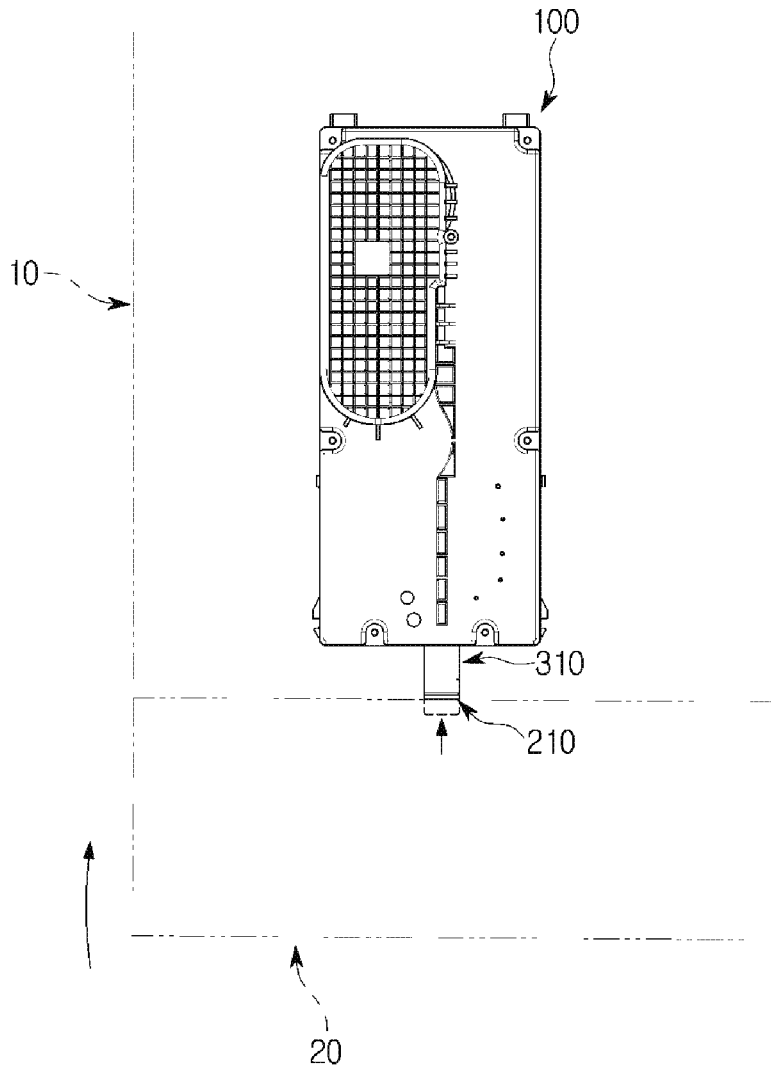
FIGS. 3 and 4 are views illustrating operation of a door opening apparatus according to one embodiment of the present disclosure.
Figure 4:
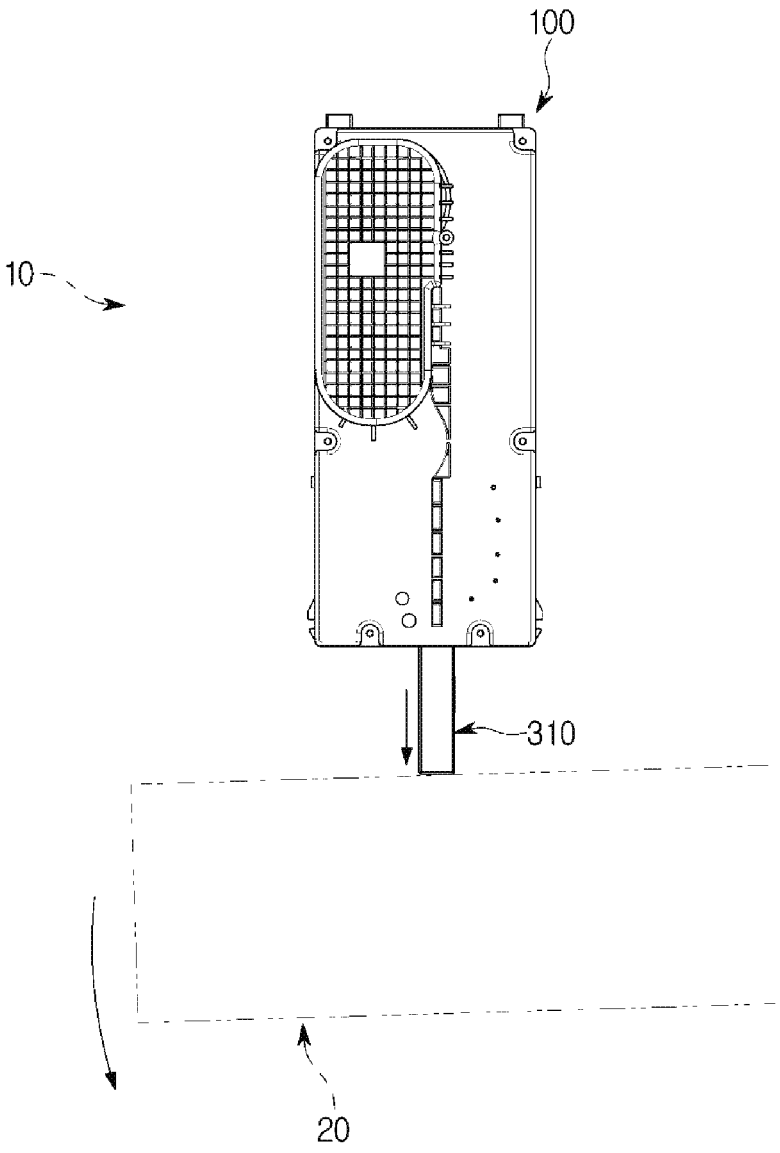

FIGS. 3 and 4 are views illustrating operation of a door opening apparatus according to one embodiment of the present disclosure.

Hereinafter, the operation of the door opening apparatus according to one embodiment of the present disclosure will be described in detail with reference to FIGS. 3 and 4.

The door opening apparatus 100 may include a detection lever 210 in contact with the door 20 when the door 20 is closed. The detection lever 210 may be provided to move rearward together with the door 20 when the door 20 is moved rearward in a state in which the detection lever 210 is in contact with the door 20. That is, the detection lever 210 may be provided to move rearward together with the door 20 according to the movement of the door 20.

When the door 20 is closed, the user may push any one side of the door 20 to move the door 20 rearward. A gasket 12 is provided between the door 20 and the main body 10, and since the gasket 12 is formed of a rubber material having elasticity, when the user pushes the door 20, the door 20 is moved rearward even by a small distance.

When the door 20 is moved rearward, and the detection lever 210 is moved toward an inside of the door opening apparatus 100 together with the door 20, a push lever 310 may be moved forward to open the door 20.

The push lever 310 may receive a driving force from a driving motor 320 which will be described below and push the door 20 forward. Therefore, the door 20 may be automatically opened by the push lever 310. The push lever 310 may be moved to an original location thereof by the driving motor 320 after opening the door 20. Accordingly, the push lever 310 may be moved rearward to the original location after being moved forward to open the door 20.

According to the spirit of the present disclosure, in the door opening apparatus 100, an additional switch is not provided at the main body 10 or the door 20. Therefore, convenience of a user may be improved, degradation of design sensibility quality may be prevented, and an increase in a material cost due to a switch may be prevented. Specifically, when the user pushes any one side of the front surface of the door 20, the door opening apparatus 100 may be operated to open the door 20. Since the user may push any position of the front surface of the door 20 to open the door 20 without pushing a switch provided at a specific location, convenience of the user may be improved. In addition, when an additional switch is provided on the door 20, there is a risk in that the switch may damage the exterior of the refrigerator, and a material cost may be increased due to the switch. However, since the door opening apparatus and the refrigerator including the same according to the spirit of the present disclosure does not include an additional switch, the above-described problems can be prevented.

Meanwhile, the door opening apparatus 100 according to one embodiment of the present disclosure does not completely open the door 20 and separates the door 20 from the main body 10 so that the user may easily open the door 20 using even a small force. That is, as the door opening apparatus 100 separates the door 20 in close contact with the main body 10 using the gasket 12 from the main body 10, an opening force may be decreased. However, the door opening apparatus 100 is not limited thereto, and the door opening apparatus 100 may also completely open the door 20 by increasing a distance by which the push lever 310 is withdrawn or changing a shape of the push lever 310 into a curved shape.

Figure 5:
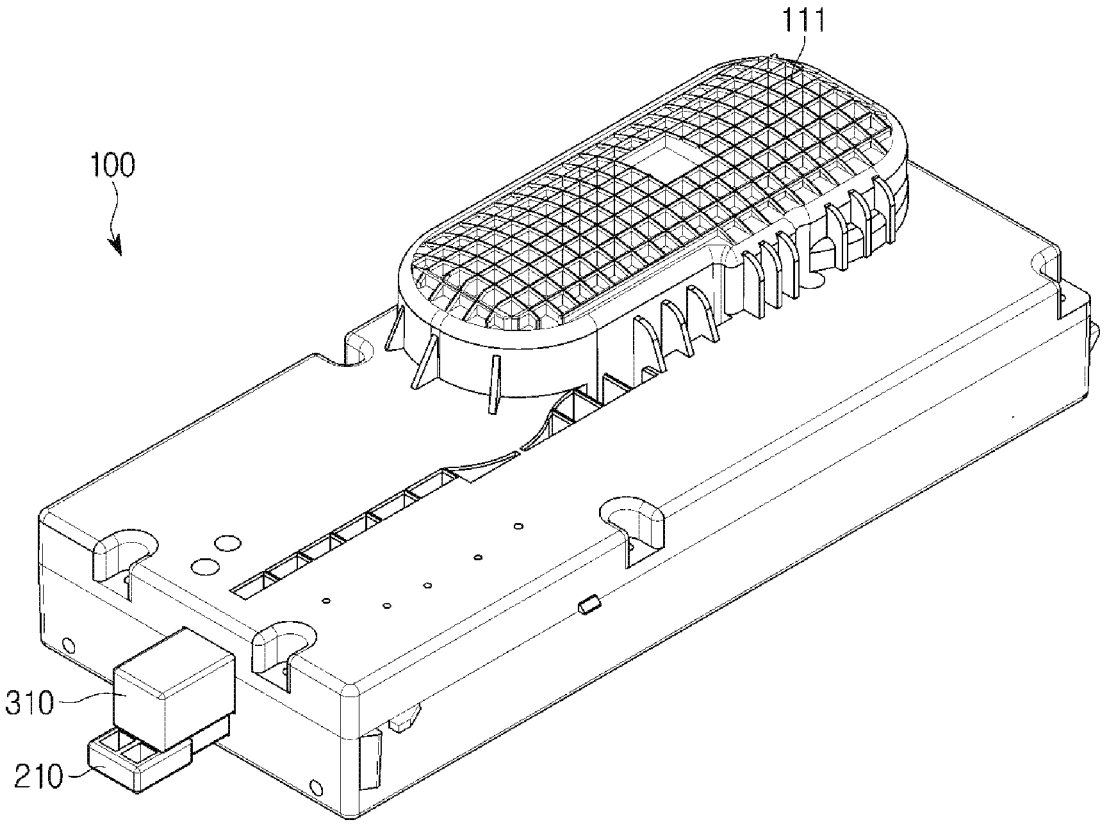
FIG. 5 is a perspective view illustrating an exterior of the door opening apparatus according to one embodiment of the present disclosure.
Figure 6:
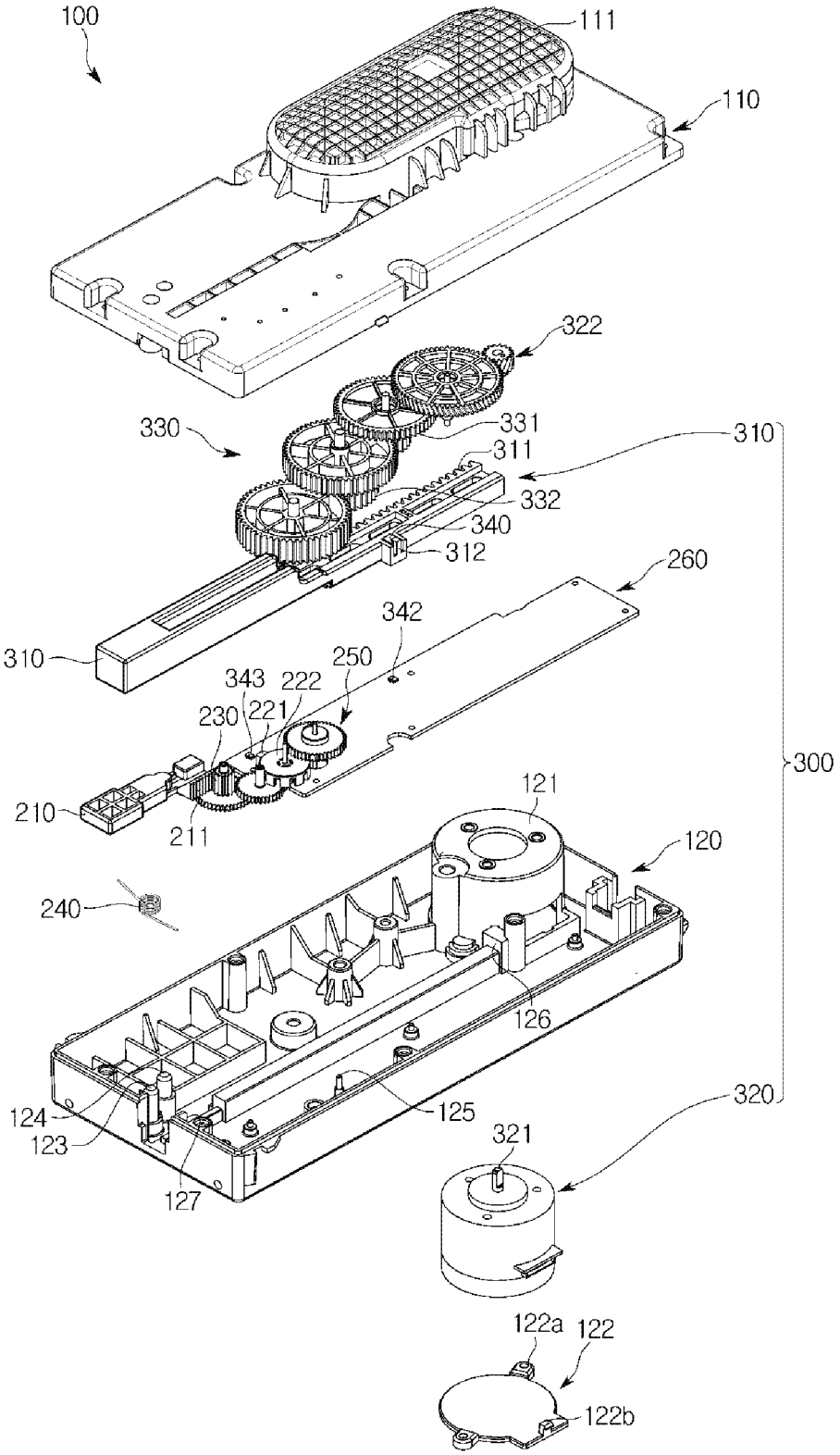
FIG. 6 is an exploded perspective view illustrating the door opening apparatus illustrated in FIG. 5.

FIG. 5 is a perspective view illustrating an exterior of the door opening apparatus according to one embodiment of the present disclosure, and FIG. 6 is an exploded perspective view illustrating the door opening apparatus illustrated in FIG. 5.

Figure 7:
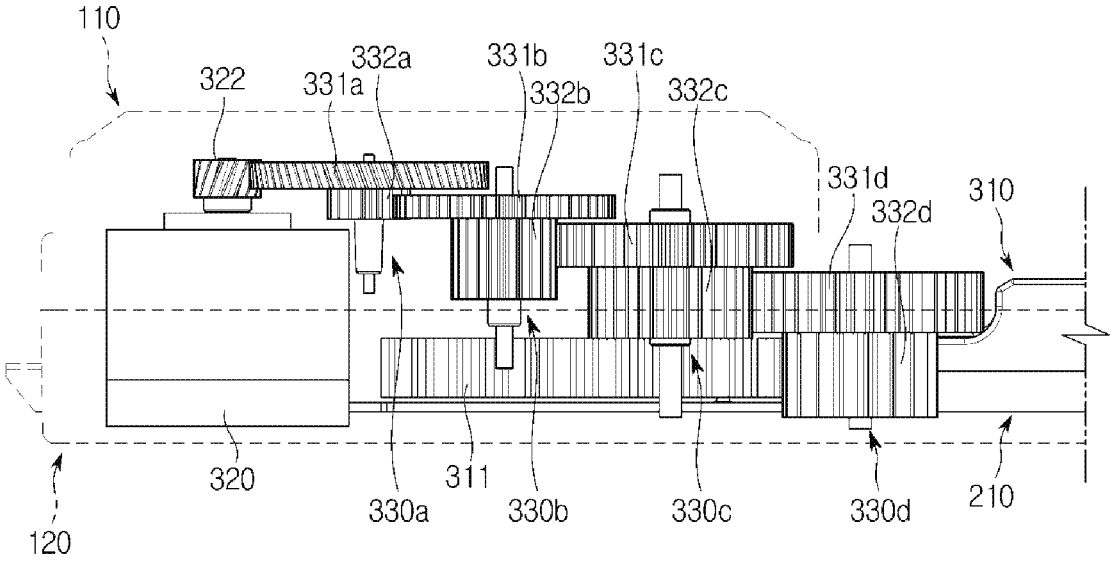
FIG. 7 is a cross-sectional view illustrating an inside of the door opening apparatus illustrated in FIG. 5.
Figure 8:
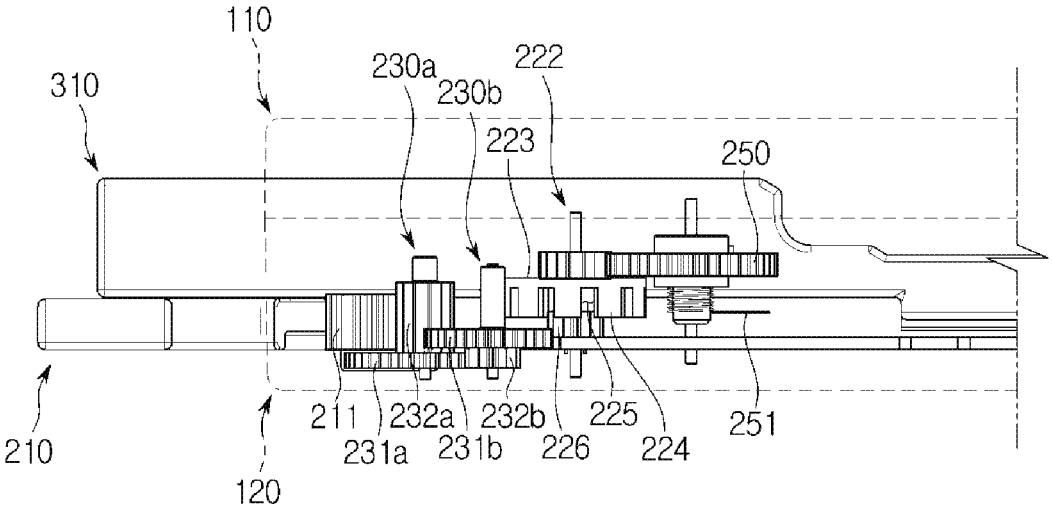
FIG. 8 is a view illustrating the door opening apparatus illustrated in FIG. 7 when viewed from a different angle.

FIG. 7 is a cross-sectional view illustrating an inside of the door opening apparatus illustrated in FIG. 5, and FIG. 8 is a view illustrating the door opening apparatus illustrated in FIG. 7 when viewed from a different angle.

Hereinafter, the door opening apparatus according to one embodiment of the present disclosure will be described in detail.

The door opening apparatus 100 may be provided to detect a moving amount of the door 20 and open the door 20 when the door 20 is pushed.

The door opening apparatus 100 may include a detection module 200 provided to detect the moving amount of the door 20, a push module 300 provided to open the door 20, and a controller (not shown) configured to receive a signal from the detection module 200 and control the push module 300.

The detection module 200 may include the detection lever 210 configured to move as much as the moving amount of the door 20, and a detecting sensor 220 configured to detect a moving amount of the detection lever 210.

The detection lever 210 may be provided to linearly move. When the door 20 is closed, the detection lever 210 may be disposed to be in contact with the door 20. The detection lever 210 may be provided to be movable forward and rearward. When the door 20 is moved rearward, the detection lever 210 may come into contact with the door 20 and move rearward together with the door 20.

The detection lever 210 may include a rack gear portion 211. As illustrated in FIG. 6, the rack gear portion 211 may be connected to an amplifying gear 230. Here, as the amplifying gear 230 is rotated, a rotating plate 222 may be rotated. Meanwhile, although not illustrated in the drawings, the rack gear portion 211 may be directly connected to the rotating plate 222 and rotate the rotating plate 222.

The detecting sensor 220 may be provided to detect the moving amount of the detection lever 210. The detecting sensor 220 may include a photo interrupter 221 including a light emitting element and a light receiving element, and the rotating plate 222 provided to rotate to repeatedly block or allow the light receiving element from receiving or to receive light emitted by the light emitting element.

The photo interrupter 221 may include the light emitting element and the light receiving element and detect that the light emitted by the light emitting element is received by the light receiving element.

The rotating plate 222 may include a circular plate shaped upper surface 223 and a plurality of light shields 224 configured to extend downward from the upper surface 223 and spaced from each other in a circumferential direction of the rotating plate 222. In addition, slits 225 may be provided between the plurality of light shields 224.

A shaft hole through which a rotational shaft passes may be provided in a center of the upper surface 223. The light shields 224 may be disposed to be spaced apart from each other along an outer edge of the upper surface 223. The light shields 224 may extend downward from the upper surface 223. The slits 225 may be formed between the continuously provided light shields 224. Accordingly, the light shield 224 and the slit 225 may be repeatedly disposed in the circumferential direction of the rotating plate 222.

The rotating plate 222 may include a gear portion 226. A rotational center of the gear portion 226 may coincide with that of the rotating plate 222. The gear portion 226 may be formed to extend downward from the center of the upper surface 223.

Although not illustrated in the drawings, the gear portion 226 may be directly engaged with the rack gear portion 211 of the detection lever 210 and convert a linear displacement of the detection lever into a rotational displacement thereof. Alternatively, as illustrated in FIG. 6, the gear portion 226 may be provided to be engaged with the amplifying gear 230.

The light shields 224 or the slits 225 may be interposed between the light emitting element and the light receiving element. When the light shields 224 are interposed between the light emitting element and the light receiving element, the light receiving element is blocked from receiving the light emitted from the light emitting element. On the other hand, when the slits 225 are interposed between the light emitting element and the light receiving element, the light receiving element may receive the light emitted from the light emitting element. That is, the light receiving element is allowed to receive the light emitted by the light emitting element.

When the rotating plate 222 rotates about the rotational shaft, the light shields 224 and the slits 225 may be repeatedly interposed between the light emitting element and the light receiving element. Therefore, the rotating plate 222 may rotate to repeatedly block or allow the light receiving element from receiving or to receive the light emitted by the light emitting element.

The detection module 200 may further include the amplifying gear 230. The amplifying gear 230 may convert the linear displacement of the detection lever 210 into the rotational displacement thereof. In addition, the amplifying gear 230 may be provided to amplify a displacement amount of the detection lever 210.

The detection lever 210 may be in contact with the door 20 and linearly move as much as the moving amount of the door 20. Here, the displacement amount of the door 20 ranges from about 0.5 to 1.5 mm which is very small, and thus it may be difficult for the detecting sensor 220 to detect the displacement amount. Alternatively, even when the detecting sensor 220 detects the displacement amount, an accuracy level thereof may be low. Accordingly, the detection module 200 may further include the amplifying gear 230 to amplify the displacement amount of the detection lever 210.

The amplifying gear 230 may include a large diameter portion 231 and a small diameter portion 232 which have the same rotational shaft. A diameter of the small diameter portion 232 may be less than that of the large diameter portion 231. Gaps between gear teeth formed at outer circumferences of the small diameter portion 232 and the large diameter portion 231 may coincide with each other.

The small diameter portion 232 may be engaged with the rack gear portion 211 of the detection lever 210. When the detection lever 210 linearly moves, the small diameter portion 232 may be provided to rotate. That is, the small diameter portion 232 may serve as a pinion gear. The amplifying gear 230 may convert the linear displacement of the detection lever 210 into the rotational displacement thereof via the small diameter portion 232.

Since the rotational shafts of the large diameter portion 231 and the small diameter portion 232 are the same, when the small diameter portion 232 rotates, the large diameter portion 231 is rotated together with the small diameter portion 232. As described above, since the gaps between the gear teeth of the small diameter portion 232 and the large diameter portion 231 are the same, when the small diameter portion 232 and the large diameter portion 231 rotate at the same angle, a greater number of gear teeth of the large diameter portion 231 than those of the small diameter portion 232 are rotated. Therefore, the amplifying gear 230 may amplify the displacement of the detection lever 210.

Meanwhile, as illustrated in FIG. 6, when two amplifying gears 230 are provided, an amplified displacement amount of the detection lever 210 may be more increased. When a plurality of amplifying gears 230 are provided, the rack gear portion 211 of the detection lever 210 is disposed to engage a small diameter portion 232*a* of a first amplifying gear 230*a*, and a large diameter portion 231*a* of a first amplifying gear 230*a* is disposed to be engaged with a small diameter portion 232*b* of a second amplifying gear 230*b*. In addition, the large diameter portion 231*b* of the second amplifying gear 230*b* may be disposed to be engaged with the gear portion 226 of the rotating plate 222. Since the number of the amplifying gears 230 is included in the design specifications, the number of the amplifying gear 230 may be increased when the amplified displacement amount of the detection lever 210 needs to be increased.

The door opening apparatus 100 may include the push module 300 provided to open the door 20.

The push module 300 may include the driving motor 320 configured to provide a driving force and the push lever 310 configured to receive the driving force from the driving motor 320 and push the door 20.

The driving motor 320 may be provided to be operated by the controller (not shown) configured to receive a signal from the detection module 200. As described above, when the user pushes the door 20, the detection module 200 may detect movement of the door through movement of the detection lever, and when the detection module 200 transmits a detected signal to the controller (not shown), the controller (not shown) may operate the driving motor 320.

The driving motor 320 may include a driving shaft 321, and a driving gear 322 may be coupled to the driving shaft 321.

The driving motor 320 may normally rotate to move the push lever 310 forward. Conversely, the driving motor 320 may reversely rotate to move the push lever 310 rearward.

The push lever 310 may be provided to linearly move. The push lever 310 may be connected to the driving motor 320, receive the driving force from the driving motor 320, and push the door 20. After the push lever 310 moves forward and comes into contact with the door 20, the push lever 310 may separate the door 20 from the main body 10 in a direction in which the door 20 is opened. After the push lever 310 moves forward to open the door 20, the push lever 310 may move rearward by the driving motor 320 to move to the original location.

The push lever 310 may include a rack gear portion 311. Although not illustrated in the drawing, the rack gear portion 311 may be directly connected to the driving motor 320 and convert a rotational displacement of the driving motor 320 into a linear displacement thereof. Here, the driving gear 322 may serve as a pinion gear. Alternatively, as illustrated in FIG. 6, the rack gear portion 311 may be connected to a decelerating gear 330. As will be described below, as the decelerating gear 330 is provided between the rack gear portion 311 of the push lever 310 and the driving gear 322 of the driving motor 320, the driving force of the driving motor 320 may be amplified.

The push module 300 may further include the decelerating gear 330 provided to decelerate the rotational displacement of the driving motor 320. The decelerating gear 330 may amplify the driving force of the driving motor 320 instead of decreasing the rotational displacement of the driving motor 320. The decelerating gear 330 may be interposed between the rack gear portion 311 of the push lever 310 and the driving gear 322 of the driving motor 320.

The decelerating gear 330 may include a large diameter portion 331 and a small diameter portion 332 having the same rotational shaft like the amplifying gear 230. A diameter of the small diameter portion 332 may be less than that of the large diameter portion 331. Gaps between gear teeth formed at outer circumferences of the small diameter portion 332 and the large diameter portion 331 may coincide with each other.

The large diameter portion 331 of the decelerating gear 330 may be engaged with the driving gear 322. The small diameter portion 332 of the decelerating gear 330 may be engaged with the rack gear portion 311 of the push lever 310. The small diameter portion 332 of the decelerating gear 330 may serve as a pinion gear and convert a rotational displacement of the driving gear 322 into a linear displacement of the push lever 310.

As the decelerating gear 330 is provided, an output of the driving motor 320 may be amplified instead of the displacement of the driving motor 320 being decreased. Meanwhile, a plurality of decelerating gears 330 may be provided. For example, as illustrated in FIG. 6, the decelerating gear 330 may include a first decelerating gear 330*a*, a second decelerating gear 330*b*, a third decelerating gear 330*c*, and a fourth decelerating gear 330*d*. Here, a first large diameter portion 331*a* of the first decelerating gear 330*a* may be engaged with the driving gear 322, and a first small diameter portion 332*a* of the first decelerating gear 330*a* may be engaged with a second large diameter portion 331*b* of the second decelerating gear 330*b*. A second small diameter portion 332*b* of the second decelerating gear 330*b* may be engaged with a third large diameter portion 331*c* of the third decelerating gear 330*c*, and similarly, a third small diameter portion 332*c* of the third decelerating gear 330*c* may be engaged with a fourth large diameter portion 331*d* of the fourth decelerating gear 330*d*. A fourth small diameter portion 332*d* of the fourth decelerating gear 330*d* may be engaged with the rack gear portion 311 of the push lever 310.

Since the output of the driving motor 320 may be increased via the decelerating gear 330, the door 20 may be opened using the driving motor 320 having a low output. In addition, since the low output driving motor 320 is used, there is an advantage in that a cost of the driving motor 320 can be decreased.

The push module 300 may further include a magnet 340 provided at one side of the push lever 310 and a hall element 341 provided to detect a magnetic field of the magnet 340.

The hall element 341 may include a first hall element 342 and a second hall element 343 disposed to be spaced apart from each other in a moving direction of the push lever 310. The magnet 340 may be provided to move between the first hall element 342 and the second hall element 343. These will be described below.

The door opening apparatus 100 may include an upper case 110 and a lower case 120 configured to form an exterior of the door opening apparatus 100 and accommodate the detection module 200 and the push module 300.

The upper case 110 may include a noise reducer 111 provided such that at least a part of the decelerating gear 330 and the driving motor 320 are disposed therein and a noise due to the driving motor 320 is reduced.

The noise reducer 111 may include a waffle-shaped rib and reduce the noise and a vibration generated by the driving motor 320.

The lower case 120 may include a driving motor installation portion 121 in which the driving motor 320 is installed and a driving motor fixing member 122 disposed below the driving motor 320 to fix the driving motor 320 to the driving motor installation portion 121.

After the driving motor 320 is inserted into the driving motor installation portion 121, the driving motor fixing member 122 may be coupled to the driving motor 320 and the driving motor installation portion 121 to install the driving motor 320 in the lower case 120. Here, couplers 122*a* and a coupling protrusion 122*b* provided on the driving motor fixing member 122 may be used to couple the driving motor fixing member 122 to the driving motor 320 and the driving motor installation portion 121.

The lower case 120 may include a first fixing pin 123 provided to fix one side of a first elastic member 240 and a second fixing pin 124 provided to fix one side of a second elastic member 251. These will be described below.

Figure 9:
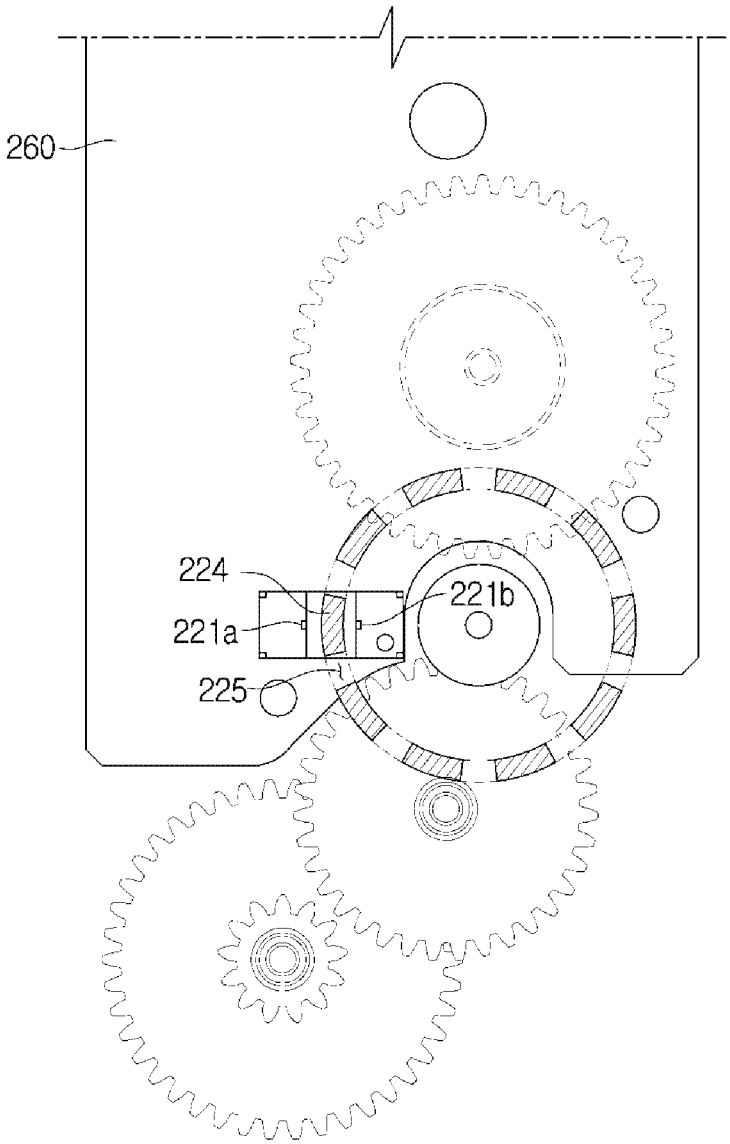
FIGS. 9 and 10 are views illustrating a rotating operation of a rotating plate of the door opening apparatus according to one embodiment of the present disclosure.
Figure 10:
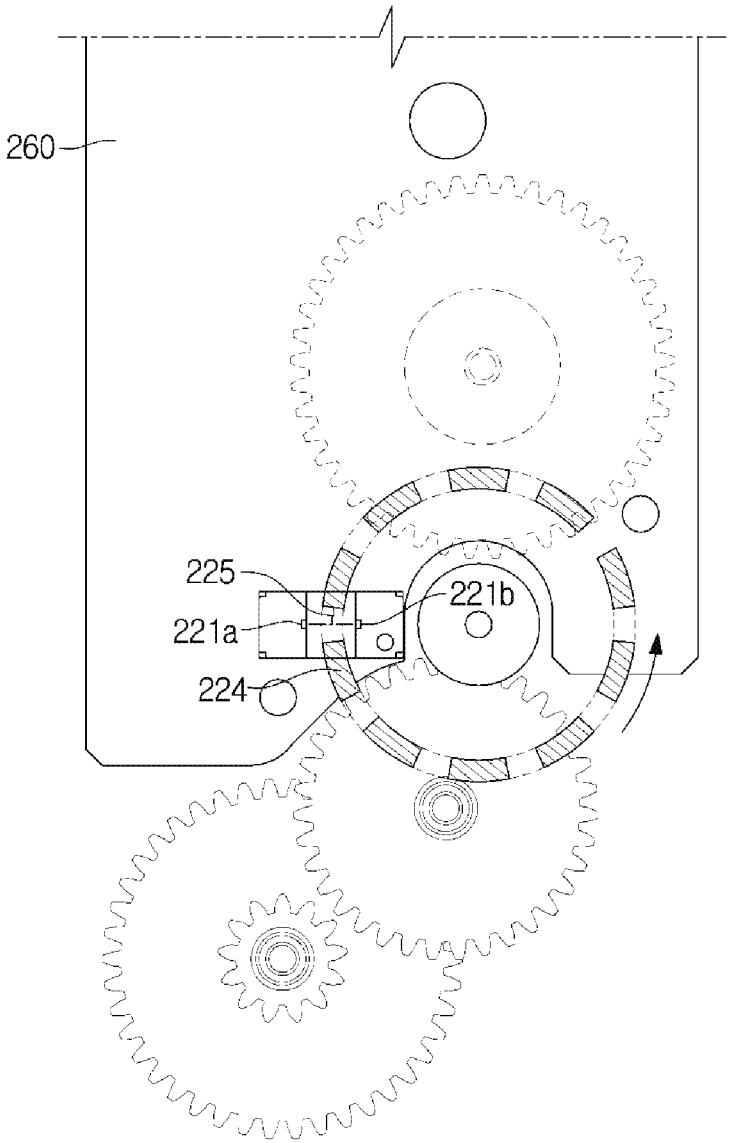
Figure 11:
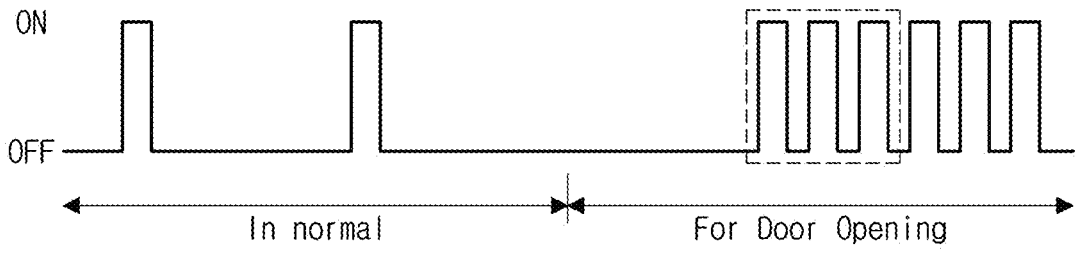
FIG. 11 is a view illustrating a light receiving signal of a photo interrupter according to rotation of the rotating plate in the door opening apparatus according to one embodiment of the present disclosure.

FIGS. 9 and 10 are views illustrating a rotating operation of a rotating plate of the door opening apparatus according to one embodiment of the present disclosure. In addition, FIG. 11 is a view illustrating a light receiving signal of a photo interrupter according to rotation of the rotating plate in the door opening apparatus according to one embodiment of the present disclosure.

Hereinafter, operation of the detecting sensor configured to detect movement of the detection lever when the detection lever moves rearward will be described in detail.

As illustrated in FIGS. 9 and 10, the photo interrupter 221 may include a light emitting element 221*a* and a light receiving element 221*b*. As described above, the light emitting element 221*a* may be provided to emit light, and the light receiving element 221*b* may be provided to receive and detect the light emitted from the light emitting element. Meanwhile, locations of the light emitting element and the light receiving element may be interchanged with each other.

As illustrated in FIG. 9, when the light shield 224 is interposed between the light emitting element 221*a* and the light receiving element 221*b*, the light receiving element 221*b* may receive the light of the light emitting element 221*a*.

On the other hand, as illustrated in FIG. 10, when the rotating plate 222 rotates and the slit 225 is interposed between the light emitting element 221*a* and the light receiving element 221*b*, the light receiving element 221*b* may receive the light of the light emitting element 221*a*.

Meanwhile, referring to FIG. 11, when the light receiving element 221*b* receives the light of the light emitting element 221*a*, the photo interrupter 221 may transmit an on signal to the controller (not shown), and when the light receiving element 221*b* does not receive the light of the light emitting element 221*a*, the photo interrupter 221 may transmit an off signal to the controller (not shown). As illustrated in FIG. 11, the controller may be provided such that the push module 300 is not operated when the controller intermittently receives the on/off signal but the push module 300 is operated only when the controller continuously receives the on/off signal. Therefore, in a case in which the door of the refrigerator moves slightly regardless of intention of the user, the door is not opened, and only when the user pushes the door of the refrigerator to open the door, the door may be opened. Accordingly, the door can be opened only when the user has intention, and convenience of the user can be improved.

Figure 12:
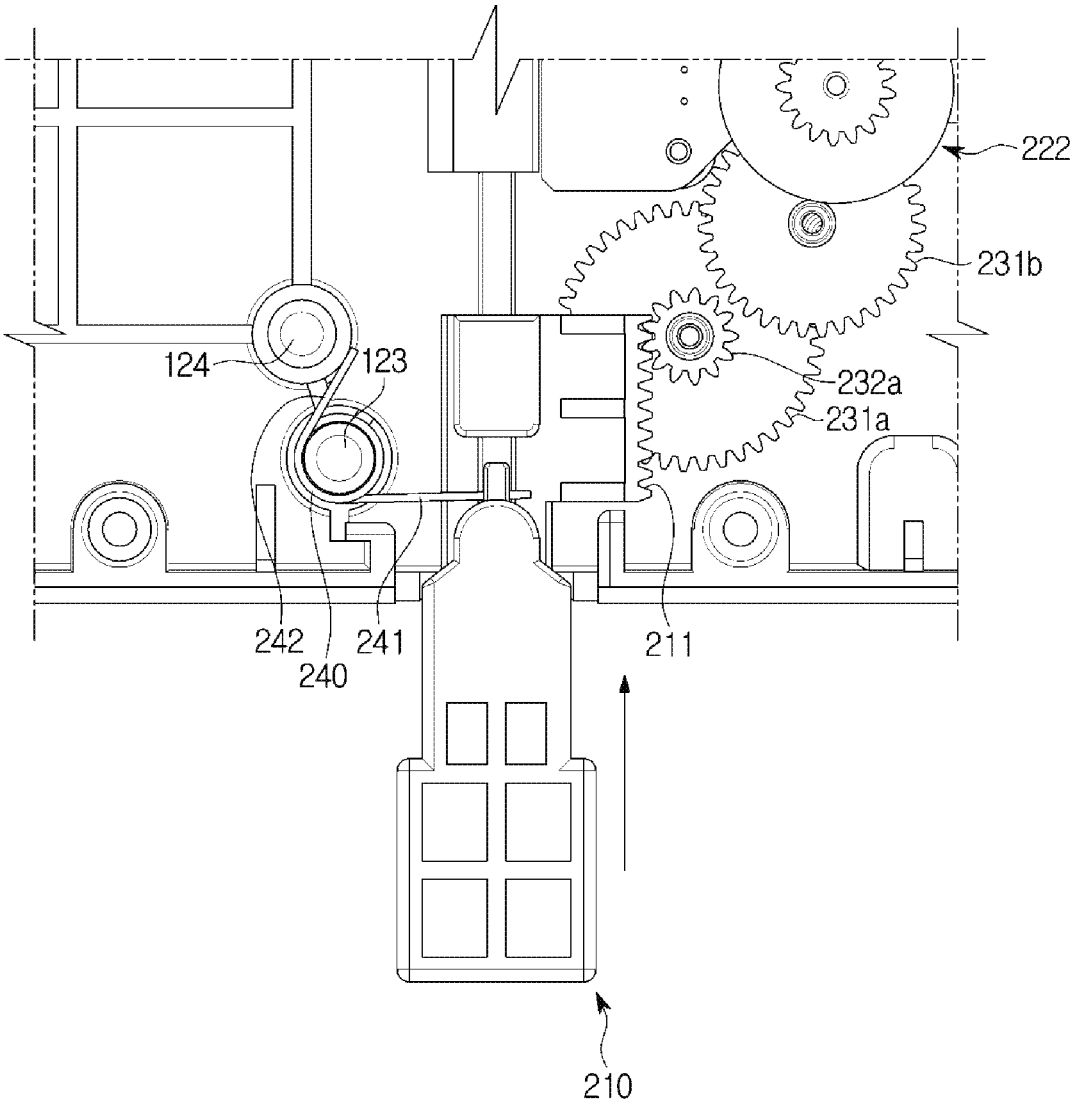
FIGS. 12 and 13 are views illustrating operation of a detection lever of the door opening apparatus according to one embodiment of the present disclosure.
Figure 13:
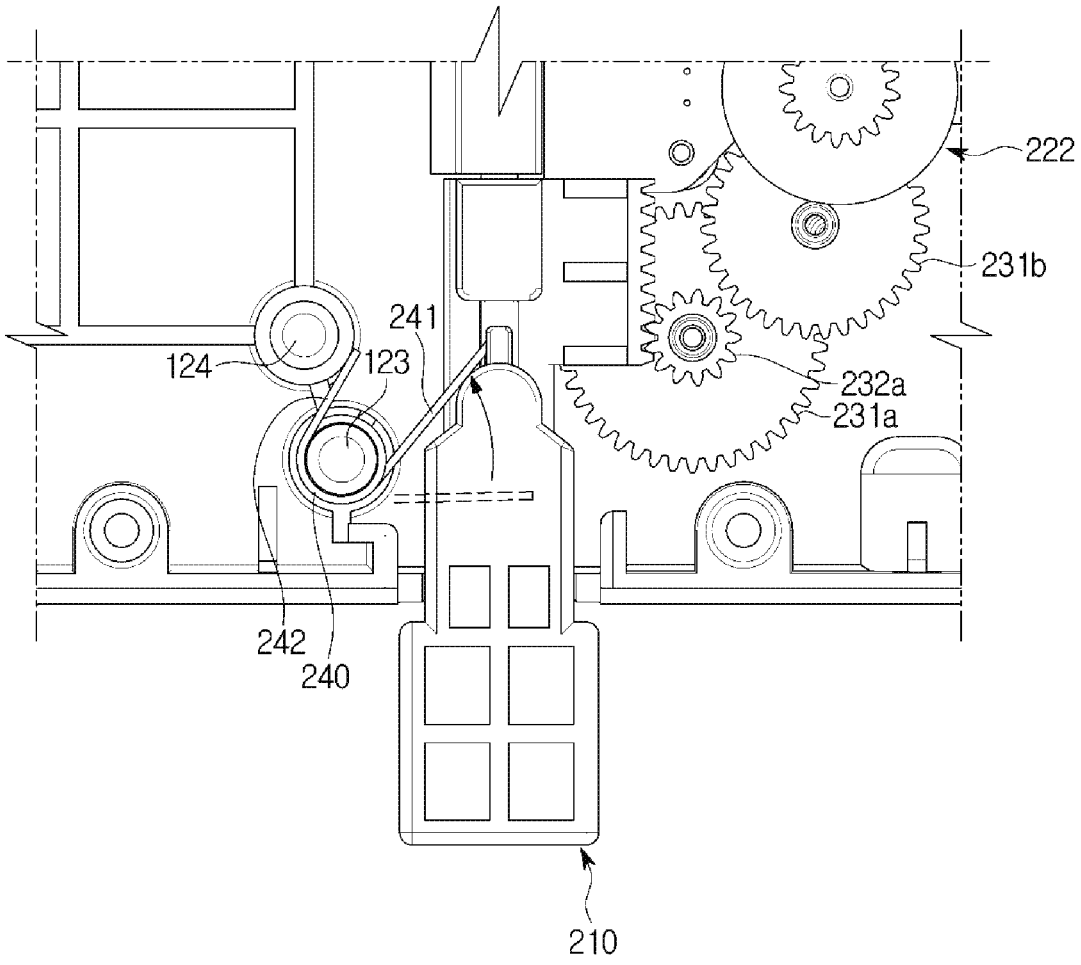

FIGS. 12 and 13 are views illustrating operation of a detection lever of the door opening apparatus according to one embodiment of the present disclosure.

The detection lever 210 may be provided to be movable forward and rearward. That is, the detection lever 210 may be provided to be linearly movable forward or rearward.

As described above, when the door 20 is pushed rearward by the user, the detection lever 210 may be moved rearward together with the door 20. However, in a case in which an additional device is not provided, the detection lever 210 moved rearward may not be moved forward.

According to one embodiment of the present disclosure, the lower case 120 may include the first fixing pin 123 and the second fixing pin 124, and the detection module 200 may further include the first elastic member 240.

The first elastic member 240 may be provided to elastically bias the detection lever 210 toward the door.

One end 241 and the other end 242 of the first elastic member 240 may be hooked at one side of the detection lever 210 and the second fixing pin 124, respectively. Here, the first elastic member 240 may be fixed to the first fixing pin 123. Through such as a structure, when the detection lever 210 moves rearward, the first elastic member 240 may accumulate an elastic force. In addition, when the door 20 is opened, the detection lever 210 may be moved forward due to the elastic force of the first elastic member 240. Accordingly, according to the spirit of the present disclosure, even when the detection lever 210 is moved rearward, the detection lever 210 is moved to an original location thereof due to the elastic force.

Meanwhile, as illustrated in FIGS. 6 to 8, according to one embodiment of the present disclosure, the detection module 200 may further include a gear 250 to elastically bias the detection lever 210 forward. In addition, the lower case 120 may further include a third fixing pin 125.

According to this, the gear 250 may be disposed to be connected to the rotating plate 222, and a second elastic member 251 may be provided inside the gear 250. One end of the second elastic member 251 is disposed inside the gear 250, and the other end thereof may be exposed toward an outside of the gear 250.

As illustrated in FIG. 8, when the detection lever 210 moves rearward, the gear 250 is rotated in one direction, and the second elastic member 251 accumulates an elastic force. When the door 20 is opened, the second elastic member 251 may rotate the gear 250 in the other direction using the accumulated elastic force. Therefore, the detection lever 210 may be moved forward due to the elastic force of the second elastic member 251. Accordingly, the detection lever 210 can be moved to the original location even when moving rearward.

Meanwhile, each of the first elastic member 240 and the second elastic member 251 is a component to elastically bias the detection lever 210 forward, and may be selectively applied to the door opening apparatus 100. However, the door opening apparatus 100 is not limited thereto, but all of the first elastic member 240, the second elastic member 251, and the gear 250 may also be applied to the door opening apparatus 100 according to one embodiment.

Figure 14:
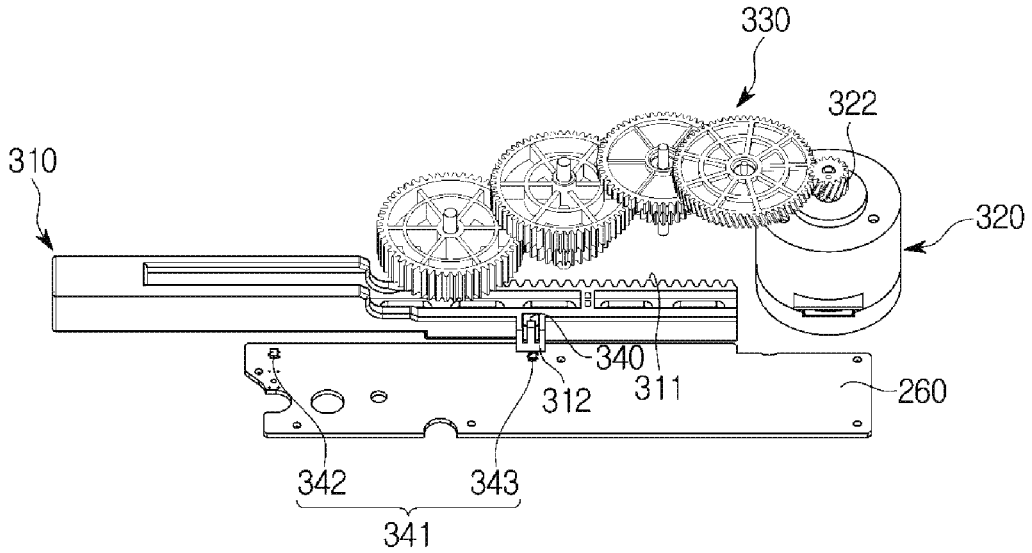
FIGS. 14 and 15 are views illustrating operation of a push lever of the door opening apparatus according to one embodiment of the present disclosure.
Figure 15:
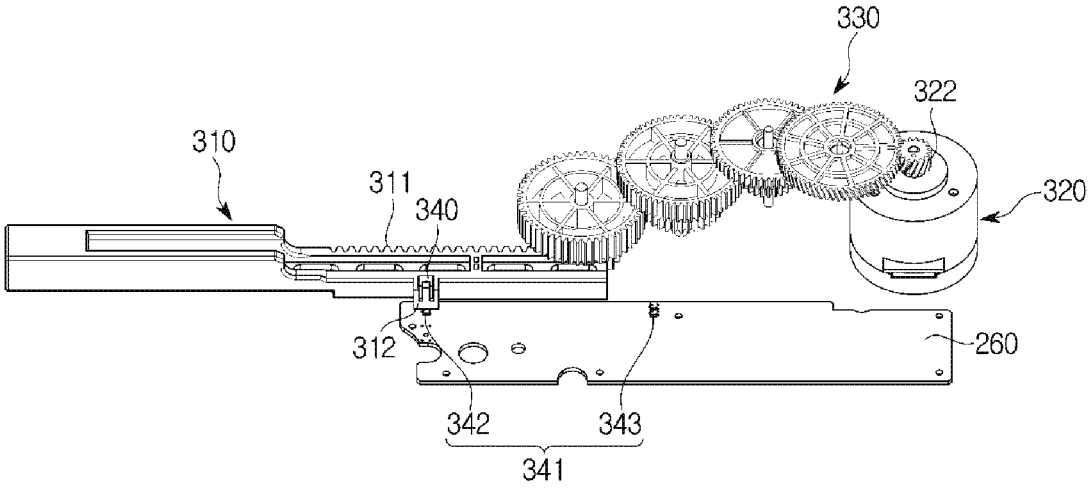

FIGS. 14 and 15 are views illustrating operation of a push lever of the door opening apparatus according to one embodiment of the present disclosure;

Hereinafter, the operation of the push lever using the magnet and the hall element will be described in detail.

The push lever 310 may include a magnet installation portion 312 formed at one side thereof. The magnet installation portion 312 may be provided at a surface opposite the rack gear portion 311. The magnet 340 may be installed in the magnet installation portion 312.

The hall element 341 may include the first hall element 342 and the second hall element 343. The hall element 341 may detect the magnetic field of the magnet 340.

According to the spirit of the present disclosure, the magnet 340 may be provided to move between the first hall element 342 and the second hall element 343.

Specifically, a position before the push lever 310 is moved forward may be referred to as a first position. In addition, a position at which the push lever 310 is maximally moved forward may be referred to as a second position. The push lever 310 may move from the first position to the second position and move from the second position to the first position to open the door 20. Here, when the push lever 310 is located at the first position, the magnet 340 may be located above the first hall element 342. In addition, when the push lever 310 is located at the second position, the magnet 340 may be located above the second hall element 343. When the driving motor 320 is operated by the controller (not shown), the push lever 310 is moved from the first position forward, and when the magnet 340 is located above the second hall element 343, the second hall element 343 may detect the magnetic field of the magnet 340, and transmit a signal to the controller (not shown). The controller (not shown) may control the driving motor 320 to be reversely rotated after receiving the signal of the second hall element 343. Therefore, the push lever 310 is not moved forward anymore from the second position and is moved rearward. When the push lever 310 moves rearward and the magnet 340 is located above the first hall element 342, the first hall element 342 may detect the magnetic field of the magnet 340 and transmit a signal to the controller (not shown), and the controller (not shown) may control the driving motor 320 to stop operating. Through this process, when the user pushes the front surface of the door 20, the push lever 310 may be moved from the first position to the second position to open the door 20 and moved from the second position to the first position which is the original location. That is, the push lever 310 may be provided to reciprocate between the first hall element 342 and the second hall element 343.

Meanwhile, according to one embodiment of the present disclosure, the first hall element 342, the second hall element 343, and the photo interrupter 221 may be mounted on a printed circuit board 260. Here, a microcomputer (not shown) provided to receive a signal from the first hall element 342 and the photo interrupter 221 and control the driving motor 320 may also be mounted on the printed circuit board 260.

In addition, although not illustrated in the drawings, the refrigerator may include a main microcomputer (not shown). The main microcomputer (not shown) may recognize state information of the refrigerator, such as an open or closed state of the door 20, and control the driving motor 320 via the microcomputer (not shown) or directly control the driving motor 320. According to one embodiment, the main microcomputer (not shown) may be provided to suppress the operation of the driving motor 320 when the door 20 is open. Through this, even when the user tries to close the door 20, the driving motor 320 is operated, and thus, repeated opening of the door 20 may be prevented.

Figure 16:
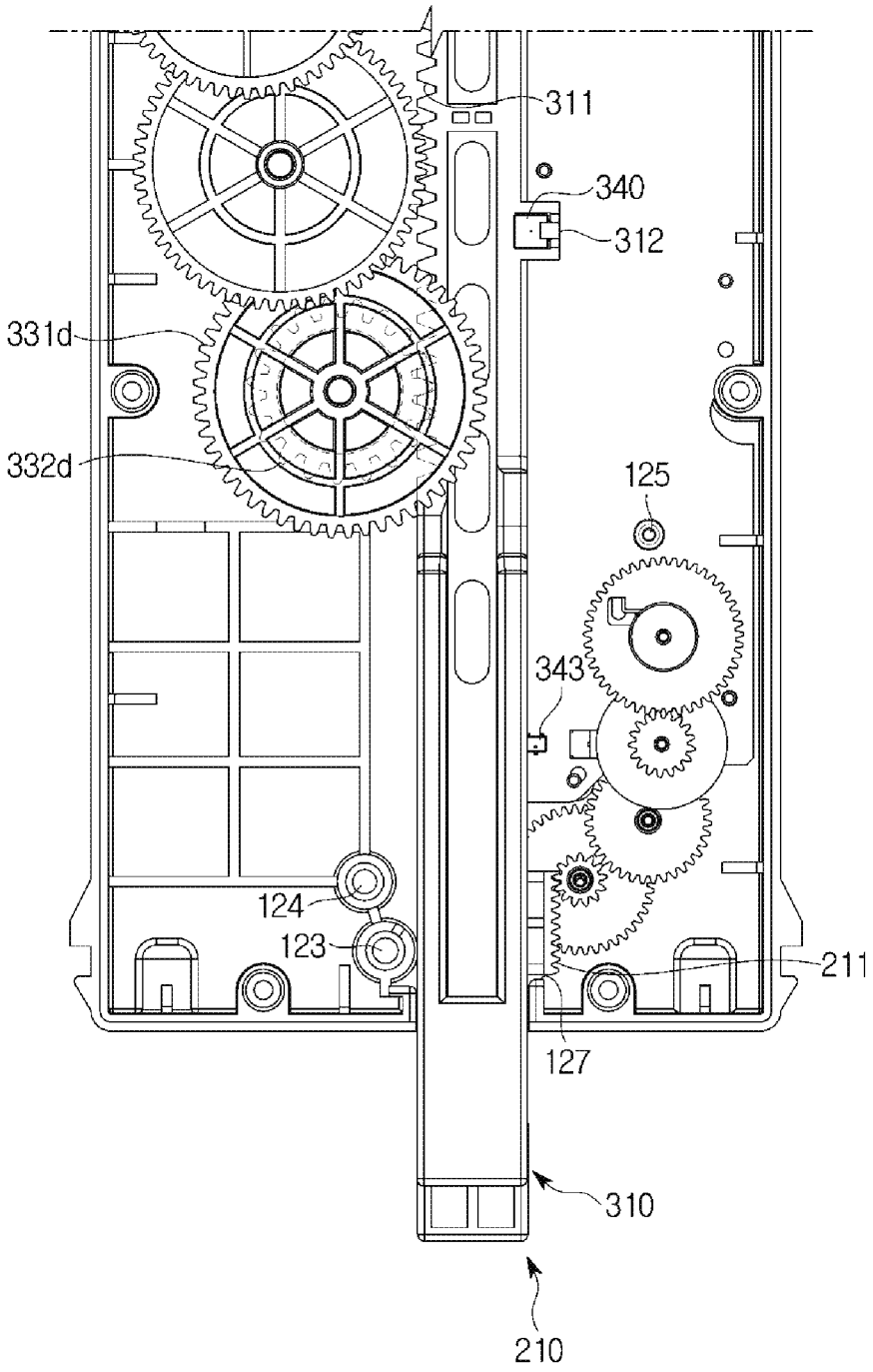
FIGS. 16 and 17 are views illustrating the operations of the push lever of the door opening apparatus according to one embodiment of the present disclosure when viewed from different angles.
Figure 17:
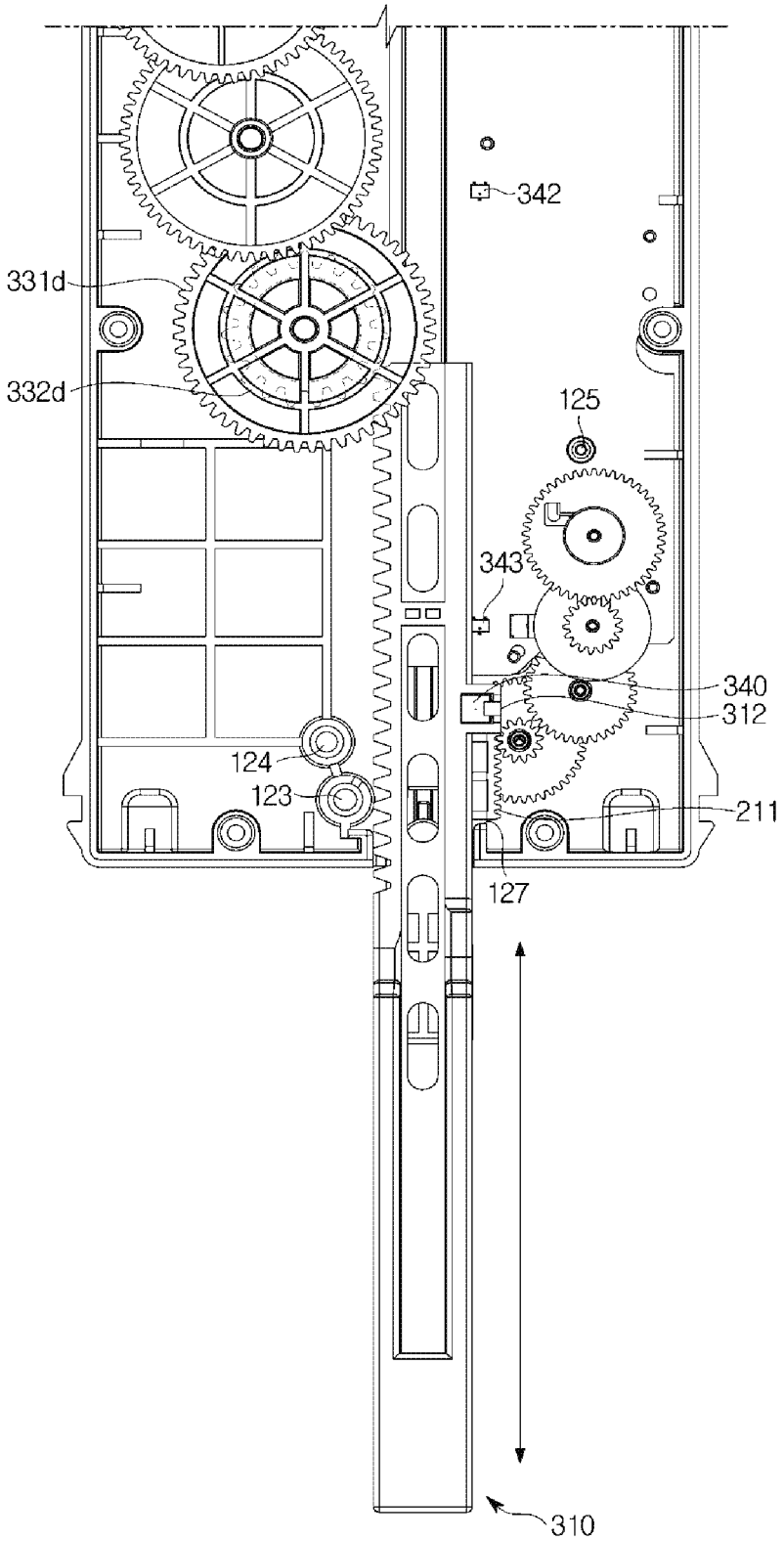

FIGS. 16 and 17 are views illustrating the operations of the push lever of the door opening apparatus according to one embodiment of the present disclosure when viewed from different angles;

As described above, the push lever 310 may be provided to reciprocate between the first hall element 342 and the second hall element 343.

However, a case, in which the hall element 341 cannot not detect the magnetic field of the magnet 340 due to an abnormality of the hall element 341, may occur. In this case, a moving range of the push lever 310 needs to be limited structurally.

As illustrated in FIG. 6, the push lever 310 may be restricted from moving rearward by a first stopper 126 provided in the lower case 120. In a case in which the magnet 340 passes by the first hall element 342 and continuously moves rearward, a rear end of the push lever 310 comes into contact with the first stopper 126, and thus the rearward movement of the push lever 310 is restricted.

As illustrated in FIGS. 16 and 17, the push lever 310 may be restricted from moving forward by a second stopper 127 provided in the lower case 120. In a case in which the magnet 340 passes by the second hall element 343 and continuously moves forward, the magnet installation portion 312 of the push lever 310 comes into contact with the second stopper 127, and thus the forward movement of the push lever 310 is restricted. However, in this case, before the magnet installation portion 312 comes into contact with the second stopper 127, connection between the small diameter portion 332*d* of the fourth decelerating gear 330*d* and the rack gear portion 311 of the push lever 310 may be released. Accordingly, the push lever 310 may not receive the driving force of the driving motor 320 anymore. Therefore, the push lever 310 may naturally stop forward moving because the driving force to move forward is disappeared before the magnet installation portion 312 comes into contact with the second stopper 127.

Figure 21:
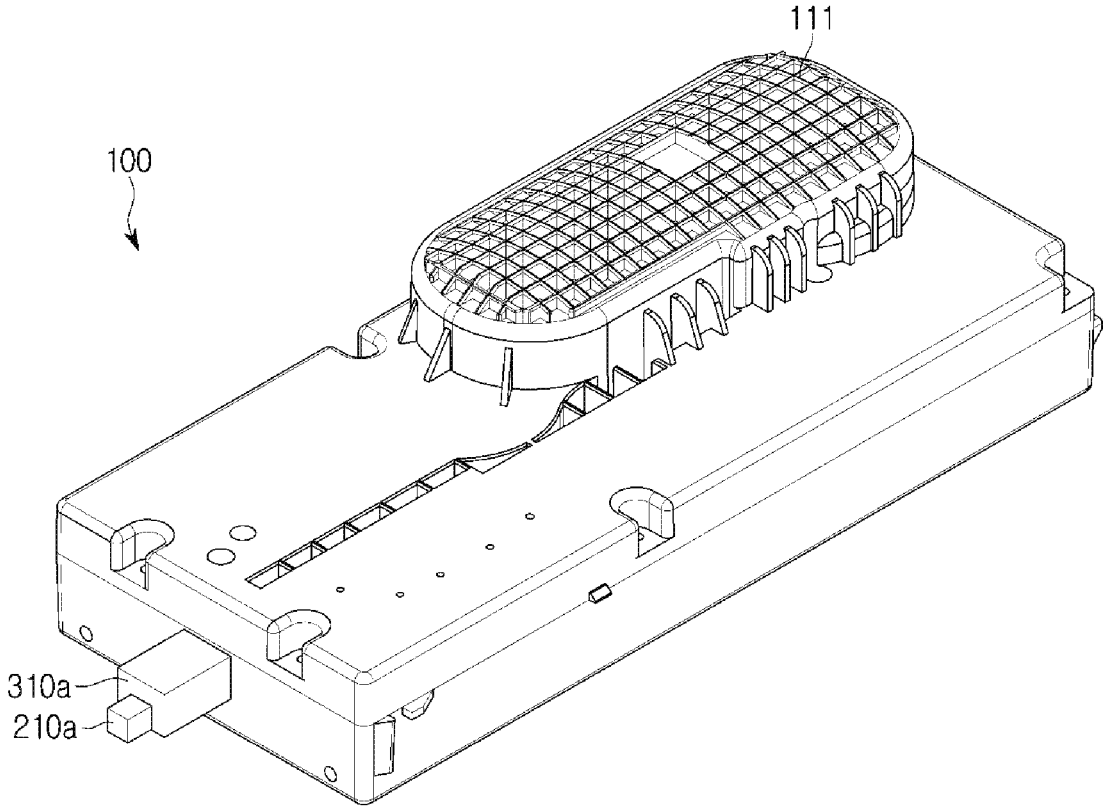
FIG. 21 is a view illustrating an exterior of a door opening apparatus according to another embodiment of the present disclosure.

FIG. 21 is a view illustrating an exterior of a door opening apparatus according to another embodiment of the present disclosure.

As illustrated in FIG. 21, in a door opening apparatus 100 according to another embodiment of the present disclosure, a design of a push lever 310*a* and a detection lever 210*a* may be changed. Unlike the door opening apparatus illustrated in FIG. 5, the detection lever 210*a* may be slidably coupled to the push lever 310*a*. However, even in this case, forward and rearward movements of the detection lever 210*a* and forward and rearward movements of the push lever 310*a* may be independently performed.

Figure 22:
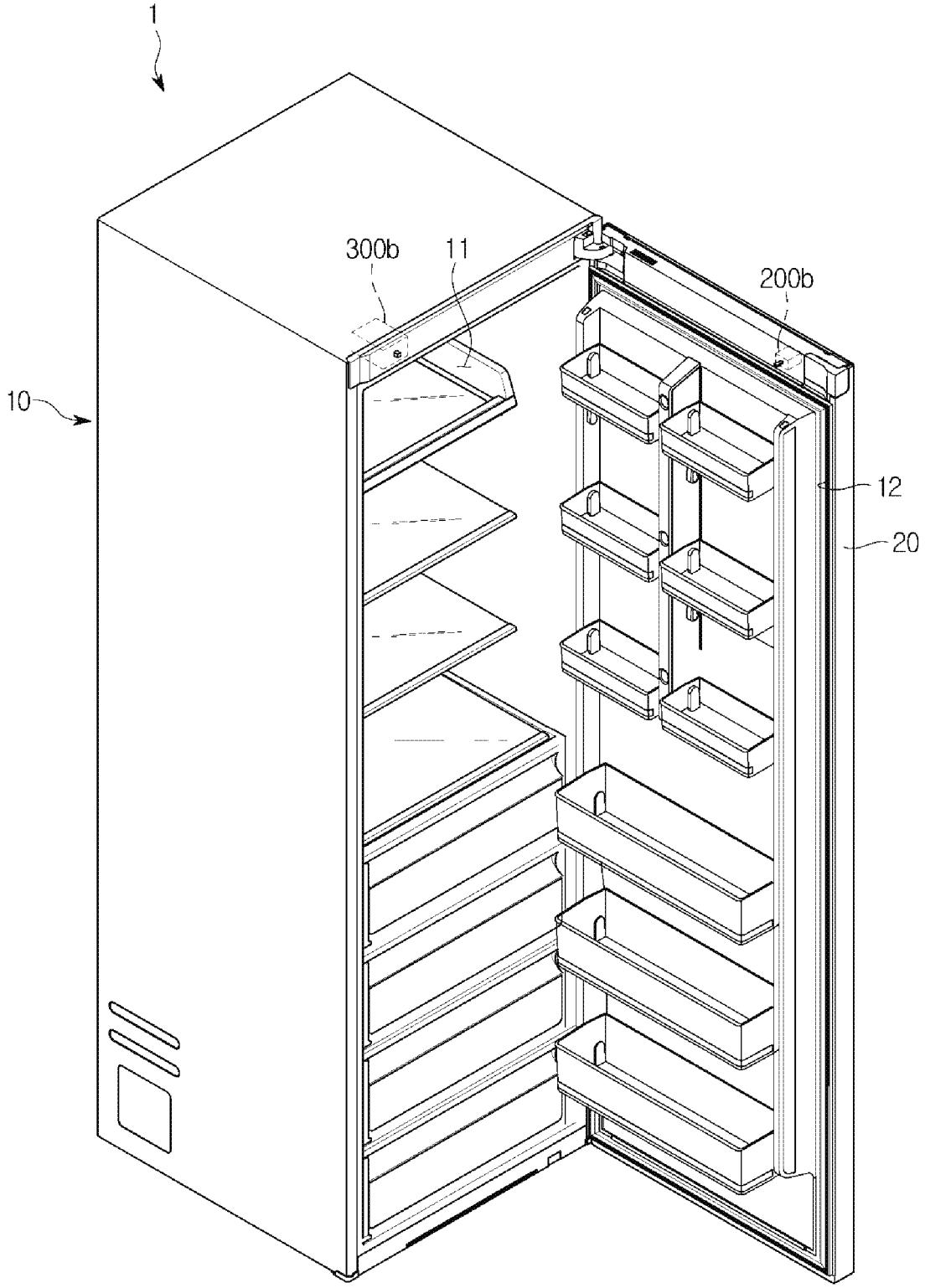
FIG. 22 is a view illustrating a door opening apparatus and a refrigerator including the same according to still another embodiment of the present disclosure.

FIG. 22 is a view illustrating a door opening apparatus and a refrigerator including the same according to still another embodiment of the present disclosure.

As illustrated in FIG. 22, in a door opening apparatus according to still another embodiment of the present disclosure, a detection module 200*b* and a push module 300*b* may be separately provided.

Here, the detection module 200*b* may be provided in a door 20, and the push module 300*b* may be provided in a main body 10. More specifically, the detection module 200*b* may be disposed at an upper portion of the door 20. In addition, the push module 300*b* may be disposed at an upper portion of the main body 10.

Meanwhile, although not illustrated in the drawings, the detection module 200*b* may be disposed at a lower portion of the door 20, and similarly, the push module 300*b* may also be disposed at a lower portion of the main body 10. Alternatively, the detection module 200*b* may be disposed at the upper portion of the door 20 and the push module 300*b* may be disposed at the lower portion of the main body 10. That is, in the case in which the detection module 200*b* and the push module 300*b* are separately provided, locations of the detection module 200*b* and the push module 300*b* may be changed according to design specifications.

Figure 18:
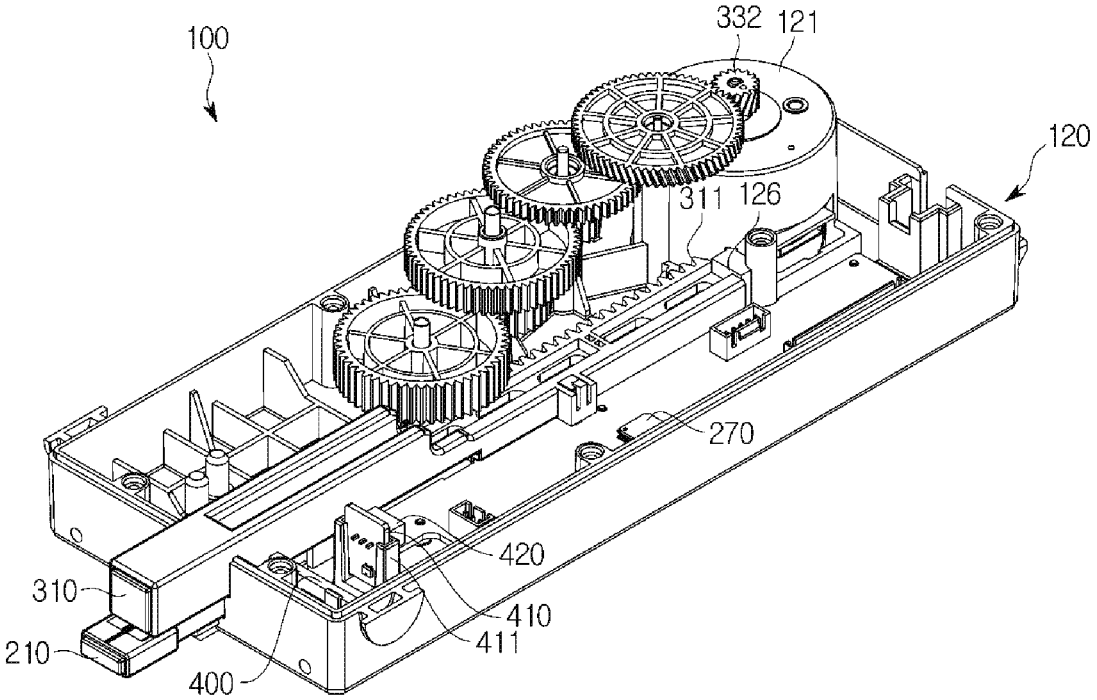
FIG. 18 is a view illustrating an inside of a door opening apparatus according to another embodiment of the present disclosure.
Figure 19:
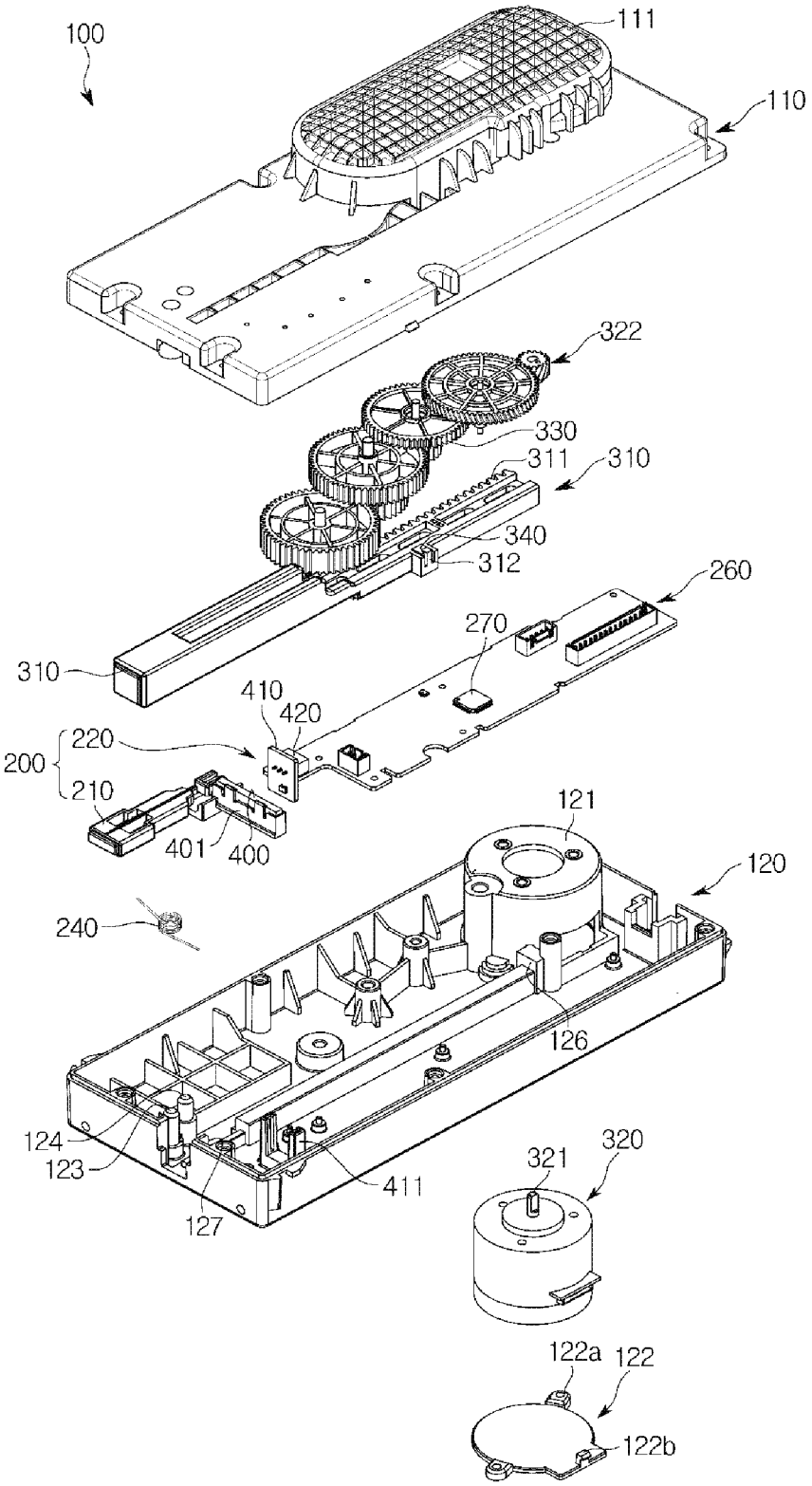
FIG. 19 is an exploded perspective view illustrating the door opening apparatus illustrated in FIG. 18.
Figure 20:
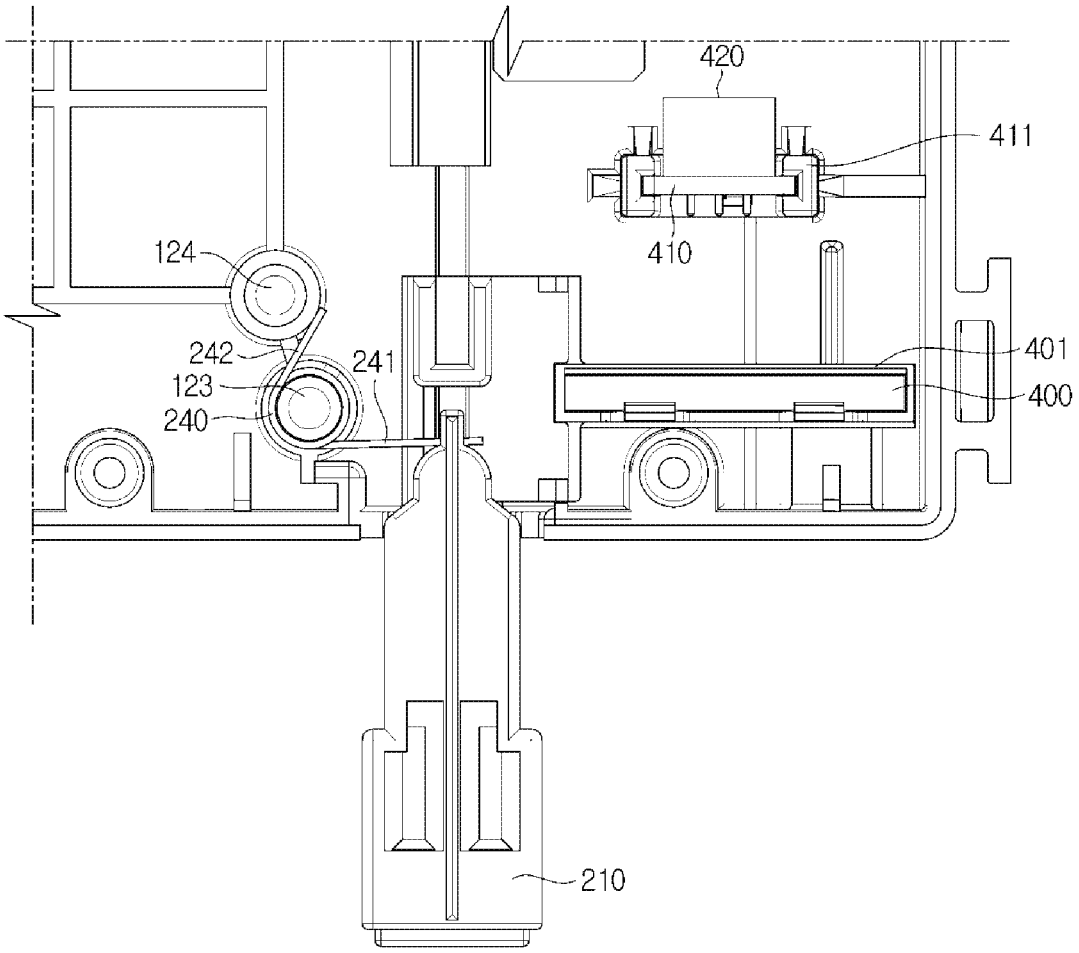
FIG. 20 is an enlarged view illustrating a part of the door opening apparatus illustrated in FIG. 18.

FIG. 18 is a view illustrating an inside of a door opening apparatus according to another embodiment of the present disclosure, and FIG. 19 is an exploded perspective view illustrating the door opening apparatus illustrated in FIG. 18. FIG. 20 is an enlarged view illustrating a part of the door opening apparatus illustrated in FIG. 18.

As illustrated in FIGS. 18 to 20, the door opening apparatus 100 may include a magnet 400 and a hall element 410.

A detection lever 210 according to the embodiment may be provided together with the magnet 400 unlike the detection lever illustrated in FIGS. 6 to 17. The magnet 400 may be installed in the detection lever 210 according to the embodiment.

The magnet 400 may be provided to move together with the detection lever 210, and the hall element 410 may be provided to detect a moving amount of the magnet 400. According to the embodiment, the door opening apparatus 100 may detect a moving amount of the door 20 using the magnet 400 and the hall element 410.

The magnet 400 may be installed at one side of the detection lever 210. The magnet 400 may be provided to move together with the detection lever 210. When the detection lever 210 is moved forward or rearward, the magnet 400 may be moved forward or rearward.

The detection lever 210 may include a magnet installation portion 401 configured to extend in a direction which intersects a moving direction of the detection lever 210. The magnet installation portion 401 may extend toward a side direction of the detection lever 210. When the magnet 400 is installed in the magnet installation portion 401, the magnet 400 may be fixed to the magnet installation portion 401. As the magnet 400 is installed in the magnet installation portion 401, the magnet 400 may be installed in the detection lever 210.

The hall element 410 may be installed in a lower case 120. A hall element installation portion 411 may be provided in the lower case 120. When the hall element 410 is installed in the hall element installation portion 411, the hall element 410 may be fixed to the lower case 120. A state in which the hall element 410 is fixed to the lower case 120 may be maintained.

The hall element 410 may be provided to detect the moving amount of the magnet 400. The hall element 410 may be provided to detect a change in a magnetic field according to movement of the magnet 400. The hall element 410 may be formed of a thin semiconductor. A specific example material of the hall element 410 may be indium-arsenide (InAs), indium-antimonide (InSb), etc.

The hall element 410 may detect a magnetic field changed by the magnet 400 as a voltage value. When the magnet 400 becomes close to the hall element 410, a magnetic force may be increased, and thus the voltage value detected by the hall element 410 may be increased. When the magnet 400 becomes far away from the hall element 410, the magnetic force is decreased, and thus the voltage value detected by the hall element 410 may be decreased. Even when the magnet 400 moves slightly, the magnetic field is changed, and the hall element 410 may detect such a change in a magnetic field. Accordingly, the hall element 410 may detect even a small displacement of the magnet 400. The voltage value detected by the hall element 410 may be transmitted to a microchip 270 mounted on a printed circuit board 260 via a jack 420.

The hall element 410 may distinguish and detect the magnet 400 being moved toward and far away from the hall element 410. Through this, the door opening apparatus 100 may distinguish between movement of the detection lever 210 due to an external impact and movement of the detection lever 210 due to a force that a user applies to the door 20 (hereinafter, a push pressure) to open the door 20. The door opening apparatus 100 may distinguish between the push pressure and the external impact applied to the door 20 and determine the user's intention. In the case of an unintended impact, since the user does not have intention to open the door 20, the door opening apparatus 100 may not open the door 20. In the case of the push pressure, since the user has intention to open the door 20, the door opening apparatus 100 may open the door 20. A process in which the door 20 is opened by a push lever 310 is the same as described above. Remaining components including a push module 300 are the same as those of the embodiment illustrated in FIGS. 6 to 17.

Meanwhile, although not illustrated in the drawings, locations of the magnet 400 and the hall element 410 may be interchanged with each other. That is, the magnet 400 may be fixed to the lower case 120, and the hall element 410 may be installed in the detection lever 210 and moved forward or rearward together with the detection lever 210. In this case, a state in which the magnet is fixed may be maintained, and the hall element may be moved forward or rearward.

As is apparent from the above description, according to the spirit of the present disclosure, a door opening apparatus capable of automatically opening a door, and a refrigerator including the same can be provided.

According to the spirit of the present disclosure, a door opening apparatus capable of preventing degradation of appearance quality of a door because an additional switch is not provided, and a refrigerator including the same can be provided.

According to the spirit of the present disclosure, a door opening apparatus capable of reducing a material cost because an additional switch is not needed, and a refrigerator including the same can be provided.

According to the spirit of the present disclosure, a door opening apparatus in which convenience of a user is improved because a door is openable by pushing one side of the door, and a refrigerator including the same can be provided.

According to the spirit of the present disclosure, a door opening apparatus capable of being installed at various doors regardless of shapes and types thereof, and a refrigerator including the same can be provided.

According to the spirit of the present disclosure, a door opening apparatus in which accuracy of opening operation and convenience of a user are improved by distinguishing a push pressure applied to a door and an external impact applied to the door to determine intention of the user, and a refrigerator including the same can be provided Although a few embodiments of the present disclosure have been shown and described above, the present disclosure is not limited to the aforementioned specific exemplary embodiments. Those skilled in the art may variously modify the present disclosure without departing from the gist of the present disclosure claimed in the appended claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body including a storage compartment;

a door provided to open or close the storage compartment; and a door opening apparatus provided to detect a moving amount of the door and open the door when the door is pushed, the door opening apparatus comprising:

a detection module provided to detect the moving amount the door, a push module provided to open the door, a controller provided to receive a signal from the detection module and control the push module, and a case configured to accommodate the detection module and the push module, wherein the case includes a first fixing pin and a second fixing pin disposed to be spaced apart from each other, wherein the detection module includes:

a detection lever provided to linearly move as much as the moving amount of the door when a front surface of the door is pushed, wherein the door contacts a first end of the detection lever when the door is closed, an amplifying gear configured to convert a linear displacement of the detection lever into a rotational displacement thereof and amplify a displacement amount of the detection lever, and an elastic member fixed to the first fixing pin and comprising a first end connected to the second fixing pin and a second end connected to a second end of the detection lever.

2. The refrigerator of claim 1, wherein:

the detection lever is provided to be in contact with the door in a state in which the door is closed and configured to be movable in a first direction and a second direction opposite the first direction; and a detecting sensor provided to detect a displacement of the detection lever.

3. The refrigerator of claim 2, wherein the detecting sensor includes:

a magnet provided at one side of the detection lever and configured to move together with the detection lever; and a hall element provided to detect a magnitude of a magnetic force changed according to a displacement of the magnet.

4. The refrigerator of claim 1, wherein the detection module includes:

a detecting sensor provided to detect the moving amount of the detection lever.

5. The refrigerator of claim 4, wherein the detecting sensor includes:

a photo interrupter including a light emitting element and a light receiving element; and a rotating plate provided to rotate to repeatedly block or allow the light receiving element from receiving or to receive light emitted from the light emitting element.

6. The refrigerator of claim 5, wherein the rotating plate includes a plurality of light shields configured to extend in a shaft direction of the rotating plate and spaced apart from each other in a circumferential direction of the rotating plate.

7. The refrigerator of claim 5, wherein:

the rotating plate includes a gear portion having a rotational center coinciding with a rotational center of the rotating plate; and the gear portion is provided to be engaged with the amplifying gear such that the rotating plate is rotated when the detection lever is moved linearly.

8. The refrigerator of claim 4, wherein the elastic member is provided to elastically bias the detection lever toward the door.

9. The refrigerator of claim 1, wherein the push module includes:

a driving motor configured to supply a driving force; and a push lever configured to receive the driving force from the driving motor and push the door in a direction in which the door is opened.

10. The refrigerator of claim 9, wherein the push module further includes a decelerating gear configured to:

decrease a rotational displacement of the driving motor, amplify the driving force of the driving motor, and transmit the driving force of the driving motor to the push lever.

11. The refrigerator of claim 10, wherein the push lever includes a rack gear portion configured to convert a rotational displacement of the decelerating gear into a linear displacement thereof and provided to be engaged with the decelerating gear.

12. The refrigerator of claim 9, wherein:

the push lever includes a magnet provided at one side of the push lever; and the push module further includes a hall element provided to detect a magnetic field of the magnet.

13. The refrigerator of claim 12, wherein:

the hall element includes a first hall element and a second hall element spaced apart from each other in a moving direction of the push lever; and the magnet is provided to move between the first hall element and the second hall element.

14. The refrigerator of claim 1, wherein the door opening apparatus is disposed at an upper end of the main body.

15. A door opening apparatus configured to open a door of a refrigerator, comprising:

a push module including a driving motor and a push lever provided to receive a driving force of the driving motor and open the door;

a detection lever configured to come into contact with the door and move in a moving direction of the door, wherein the door contacts a first end of the detection lever when the door is closed;

a detecting sensor provided to detect a moving amount of the detection lever;

a case configured to accommodate the push module, the detection lever, and the detecting sensor, wherein the case includes a first fixing pin and a second fixing pin disposed to be spaced apart from each other;

an amplifying gear connected to the detection lever and the detecting sensor and provided to convert a linear displacement of the detection lever into a rotational displacement thereof and amplify a displacement amount of the detection lever; and an elastic member fixed to the first fixing pin and comprising a first end connected to the second fixing pin and a second end connected to a second end of the detection lever.

16. The door opening apparatus of claim 15, wherein the detecting sensor includes:

a photo interrupter including a light emitting element and a light receiving element; and a rotating plate configured to rotate to repeatedly block or allow the light receiving element from receiving or to receive light emitted from the light emitting element.

17. The door opening apparatus of claim 15, wherein:

the push lever includes a magnet provided at one side of the push lever; and the push module further includes a hall element provided to detect a magnetic field of the magnet.

* * * * *